US011746982B1

(12) United States Patent
Lee

(10) Patent No.: US 11,746,982 B1
(45) Date of Patent: Sep. 5, 2023

(54) LAMP FOR VEHICLE

(71) Applicant: HYUNDAI MOBIS CO., LTD., Seoul (KR)

(72) Inventor: Hyun Soo Lee, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/813,305

(22) Filed: Jul. 18, 2022

(30) Foreign Application Priority Data

May 4, 2022 (KR) ..... 10-2022-0055214

(51) Int. Cl.
*F21S 41/683* (2018.01)
*F21S 41/47* (2018.01)
*F21S 41/43* (2018.01)
*F21S 41/25* (2018.01)

(52) U.S. Cl.
CPC ..... *F21S 41/683* (2018.01); *F21S 41/25* (2018.01); *F21S 41/43* (2018.01); *F21S 41/47* (2018.01)

(58) Field of Classification Search
None
See application file for complete search history.

(56) References Cited

U.S. PATENT DOCUMENTS 10,612,741 B2 * 4/2020 Moser ..... F21S 41/683
11,193,643 B2 * 12/2021 Kemetmüller et al. F21S 41/24
2019/0322209 A1 10/2019 Sugiyama
2021/0278054 A1 9/2021 Lee
2021/0341123 A1 11/2021 Mototsuji

FOREIGN PATENT DOCUMENTS

DE 10 2020 102226 8/2021
DE 20 2021 103908 8/2021
DE 10 2021 120990 3/2022
EP 3 751 191 12/2020

OTHER PUBLICATIONS

Extended European Search Report dated Dec. 23, 2022 issued in EP 22185906.9.
English Language Abstract of DE 10 2020 102226 published Aug. 5, 2021.
English Language Abstract of DE 10 2021 120990 published Mar. 3, 2022.
English Language Abstract of DE 20 2021 103908 published Aug. 6, 2021.

* cited by examiner

*Primary Examiner* — Anabel Ton
(74) *Attorney, Agent, or Firm* — DLA PIPER LLP (US)

(57) ABSTRACT

A lamp for a vehicle includes a light source device to generate and output light, and a lens array provided in front of the light source device. The lens array includes a first lens device including a plurality of first micro-lenses to receive light incident thereto from the light source device, and a second lens device including a plurality of second micro-lenses provided to irradiate light, which is incident thereto from the first lens device, on the road surface to form a specific beam pattern. The beam pattern is divided into a plurality of pattern regions depending on a distance from the lamp for the vehicle. The lens array is divided into a plurality of partition regions corresponding to the plurality of pattern regions, respectively.

12 Claims, 30 Drawing Sheets

LAMP FOR VEHICLE

CROSS-REFERENCE TO RELATED APPLICATION

This application claims the benefit of priority to Korean Patent Application No. 10-2022-0055214, filed in the Korean Intellectual Property Office on May 4, 2022, the entire contents of which are incorporated herein by reference.

TECHNICAL FIELD

The present disclosure relates to a lamp for a vehicle, and more particularly, to a lamp for a vehicle employing a micro-lens array.

BACKGROUND

A micro-lens array (MLA) projects an image by arranging a plurality of micro lenses. The micro lens array in a smaller size shows an image having excellent quality, so the micro-lens array has been widely used in various fields. Recently, researches and studies have been performed to reduce the size of a lamp of a vehicle (or a vehicle lamp) by using a micro-lens having a shorter focal length.

When a vehicle lamp having such a micro-lens array irradiates light onto a road surface while being tilted, a quantity of light may be reduced with respect to a longer distance pattern, so the uniform pattern may not be ensured. Accordingly, a technology for improving the uniformity of an optical pattern is necessary by minimizing the loss in the quantity of light.

When the vehicle lamp having the micro-lens array irradiates light onto a road surface while being tilted, a resolution and optical performance may be degraded. In addition, conventionally, an optical system is mounted to be tilted such that light is tilted and irradiated onto a road surface. In this case, an inner area of the lamp, which is occupied by the optical system, is increased to increase the size of the vehicle lamp.

Meanwhile, in general, a Welcome Ceremony technology is to provide various pieces of information, such as a vehicle state before vehicle driving, to a driver, thereby significantly increasing the convenience and the productivity. A welcome light or a puddle lamp, which is one example of the welcome ceremony technology, is turned on a side surface of a vehicle to form a beam pattern when the vehicle is unlocked through a smart key. Accordingly, the welcome light or the puddle lamp is a technology to enhance the productivity of the vehicle and to provide information such as a parking position.

Recently, a projection-type optical system equipped with a micro-lens array has been used for a vehicle lamp to display specific information on a road surface, which is similar to the welcome light.

However, the convention projection-type optical system is provided to realize only one pattern in a static image form. Accordingly, the conventional projection-type optical system may not realize a dynamic image. According to the related art, when the dynamic image is realized, the visibility may not be ensured or the intuitive understanding of the information may be difficult.

In addition, according to the related art, since one optical system is provided to realize an image, the difference in brightness is made between a longer distance pattern and a shorter distance pattern of a beam irradiated onto the road surface. Accordingly, uniform patterns may not be ensured.

SUMMARY

The present disclosure has been made to solve the above-mentioned problems occurring in the prior art while advantages achieved by the prior art are maintained intact.

An aspect of the present disclosure provides a vehicle lamp in which a lens array is separately designed for each partition region such that an optical system having the optimal orientation angle and the optimal luminous intensity are realized, thereby improving the light uniformity of the pattern of the beam irradiated onto the road surface.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, a lamp for a vehicle includes a light source device to generate and output light and a lens array provided in front of the light source device. The lens array includes a first lens device including a plurality of first micro-lenses to receive light incident thereto from the light source device, and a second lens device including a plurality of second micro-lenses provided to irradiate light, which is incident thereto from the first lens device, on the road surface to form a specific beam pattern. The beam pattern is divided into a plurality of pattern regions depending on a distance from the lamp for the vehicle. The lens array is divided into a plurality of partition regions corresponding to the plurality of pattern regions, respectively, and provided to increase a focal length of the second micro-lens provided in a partition region corresponding to a pattern region, as the pattern region is positioned at a distance longer from the lamp for the vehicle The lamp may further include a shielding part interposed between the first lens device and the second lens device to shield a portion of the light from the first lens device to the second lens device, such that a specific beam pattern is formed on the road surface.

The shielding part may include a plurality of unit masks provided to correspond to the plurality of second micro-lenses, respectively, and having a masking pattern for forming the beam pattern. The unit mask may include a shielding region provided to shield light, and a light transmitting region provided to transmit light and having a shape corresponding to the masking pattern.

The lamp may be provided to decrease a curvature of a second micro-lens, which is provided in a partition region corresponding to a pattern region, as the pattern region is positioned at a distance longer from the lamp for the vehicle.

The lamp may be provided to increase a thickness of a second micro-lens, which is provided in a partition region corresponding to a pattern region, as the pattern region is positioned at a distance longer from the lamp for the vehicle.

The first micro-lens and the second micro-lenses provided in the same partition region may be formed to be equal to each other in width in a vertical direction, and the width may be within a machining error range.

The lamp may be provided to increase a curvature of a first micro-lens, which is provided in a partition region corresponding to a pattern region, as the pattern region is positioned at a distance longer from the lamp for the vehicle.

On the assumption that an optical axis of light, which is output from the light source device and incident toward the first lens device, is referred to as a first optical axis, and an optical axis of light, which is output from the second lens device, is referred to as a second optical axis, the lens array is formed such that the second optical axis is tilted about the first optical axis to extend toward the road surface.

The size of an acute angle of angles, which are formed between the first optical axis and the second optical axis, is reduced in a partition region corresponding to a pattern region, as the pattern region is positioned a distance longer from the lamp for the vehicle.

For example, the second lens device may further include a second light transmitting body, which includes the second micro-lens formed on a surface facing a direction opposite to a direction facing the light source device, and provided to transmit the light. The second micro-lenses may be provided in the second light transmitting body, such that a thickness direction of the second micro-lenses is titled about the direction of the first optical axis.

The plurality of partition regions may be placed in quadrant plates obtained by dividing the lens array about the optical axis of the light source device. The plurality of partition regions may be provided to form pattern regions at distances which are gradually longer from the lamp for the vehicle, counterclockwise from the partition region corresponding to a pattern region at a distance shortest from the lamp for the vehicle.

The lamp for the vehicle may further include a driving shield unit. The driving shield unit may include a rotating shield interposed between the light source device and the lens array, having an opening formed through the rotating shield having a size corresponding to one of the plurality of partition regions and provided to be rotatable.

The rotating shield may be formed in the shape of a disk perpendicular to the optical axis of the light source device. The driving shield unit may include a driving motor to provide driving force, and a transfer gear connected to a driving shaft of the driving motor and engaged with a gear formed at an edge of the rotating shield. The driving shield unit may be provided to transform a lamp image of the beam pattern, by changing the position of the opening, as the rotating shield rotates.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Hereinafter, exemplary embodiments of the present disclosure will be described with reference to accompanying drawings.

The following embodiments are embodiments appropriate to allow those skilled in the art to understand the technical features of a lamp for a vehicle according to the present disclosure. However, the present disclosure or the features of the present disclosure is not limited to embodiments to be described below, and various modifications are possible within the technical scope of the present disclosure.

According to the present disclosure, a lamp 100, 200, 300, or 400 for a vehicle, which is a vehicle lamp using a micro-lens array, may be, for example, a guide lamp to realize a pattern image having a specific shape on a road surface 2 by projecting light to the road surface 2 which is in the vicinity of a vehicle 1.

For example, according to the present disclosure, the vehicle lamp 100, 200, 300, or 400 may be a reverse guide lamp, a welcome guide lamp, and a turn signal guide lamp which is lit together with a reverse lamp. The following description will be made while focusing on the case that the vehicle lamp 100, 200, 300, or 400 according to the present disclosure is the reverse guide lamp (see FIG. 1) or a turn signal lamp (see FIG. 15). In addition, according to the present disclosure, various vehicle lamps 100, 200, 300, or 400 may be employed without limitation, as long as the vehicle lamp irradiates light in a specific pattern on the road surface.

In this case, the vehicle lamp 100, 200, 300, or 400 irradiates light onto the road surface while being frequently titled. Accordingly, the difference in brightness may be made between a longer distance pattern region, which is positioned at a longer distance from the vehicle lamp, and a shorter distance pattern region which is positioned at a shorter distance from the vehicle lamp. In other words, the brightness of the longer distance pattern region becomes darker than the brightness of the shorter distance pattern region, so the light uniformity may be degraded. The present invention suggests a technology of solving the above problem.

First Embodiment

Figure 1:
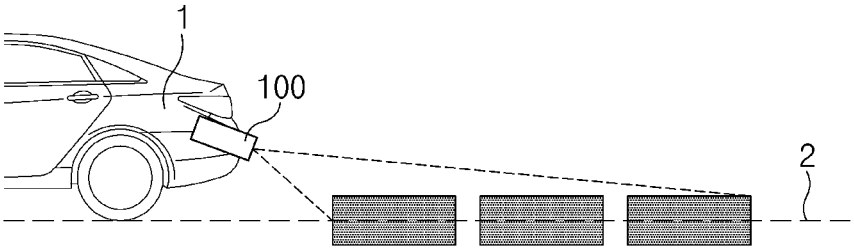
FIG. 1 is a view illustrating that a vehicle lamp is mounted in a vehicle, according to a first embodiment of the present disclosure.
Figure 2:
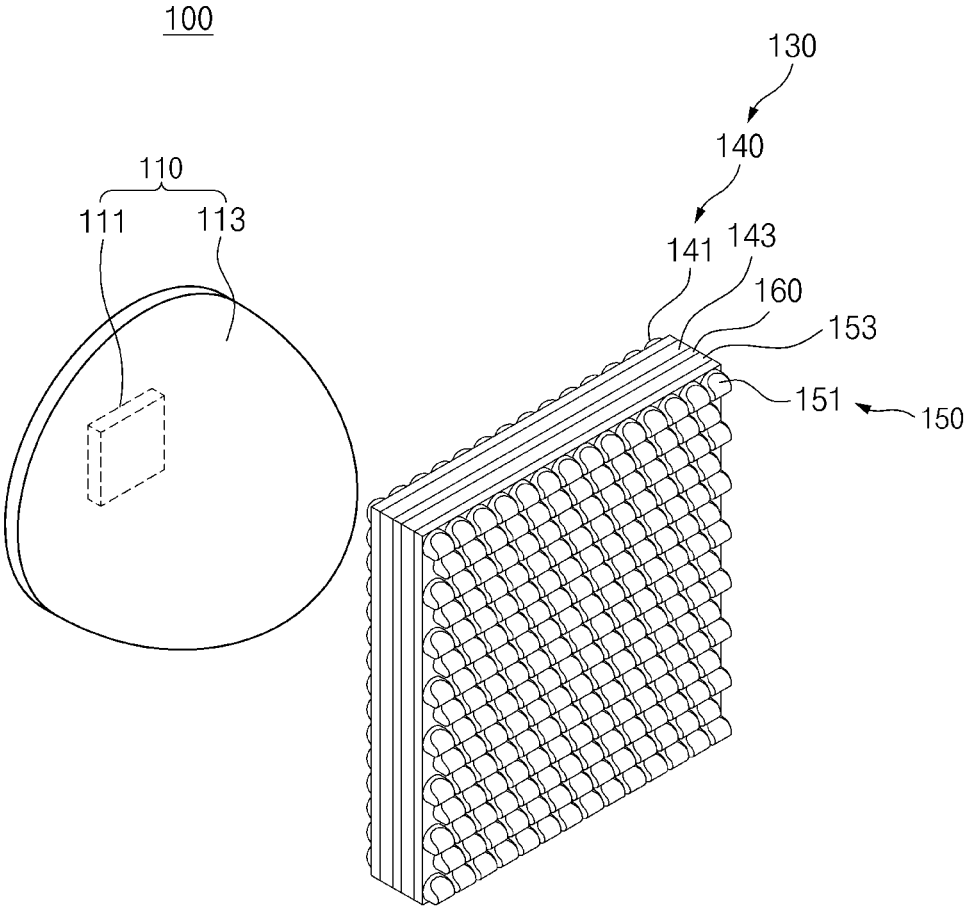
FIG. 2 is a perspective view illustrating a vehicle lamp, according to the first embodiment of the present disclosure.
Figure 3:
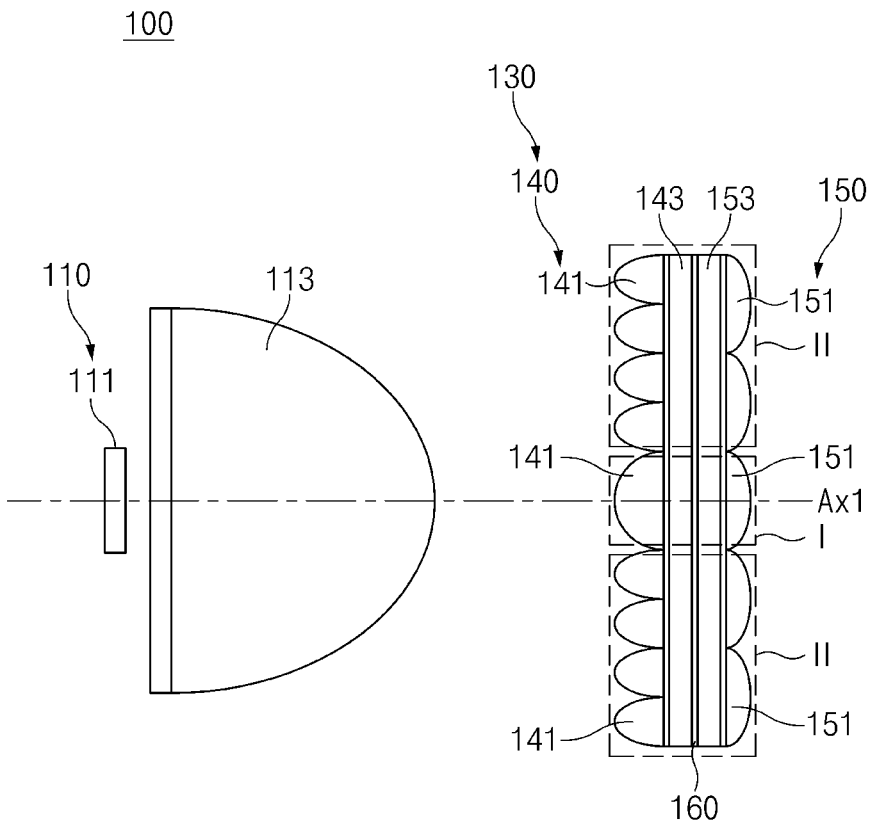
FIG. 3 is a cross-sectional view illustrating a vehicle lamp, according to the first embodiment of the present disclosure.
Figure 4:
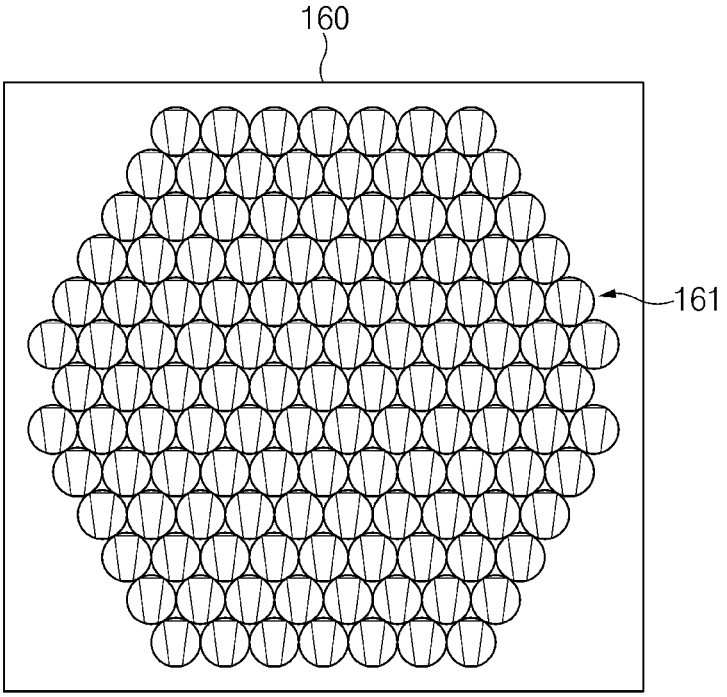
FIG. 4 is a front view illustrating a lens array, according to the first embodiment of the present disclosure.
Figure 5:
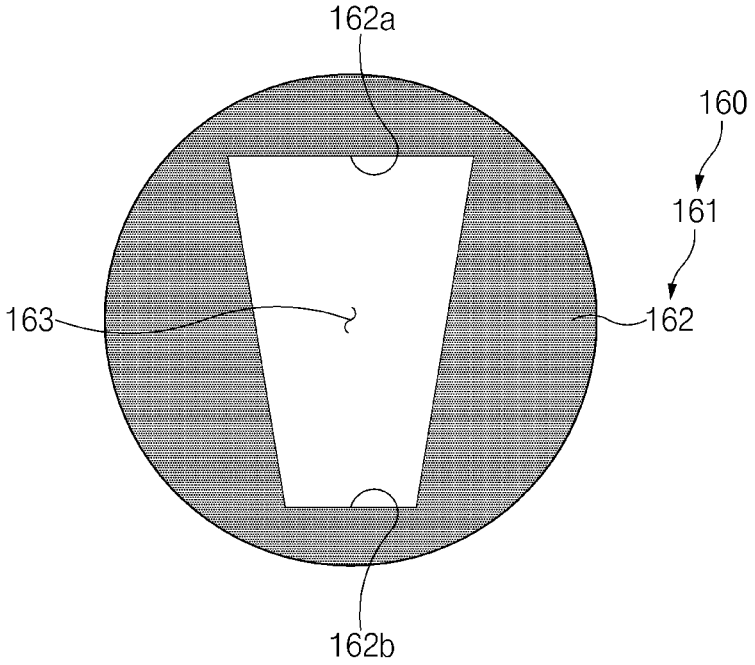
FIG. 5 is a view illustrating a unit mask of a shielding part, according to the first embodiment of the present disclosure.
Figure 6:
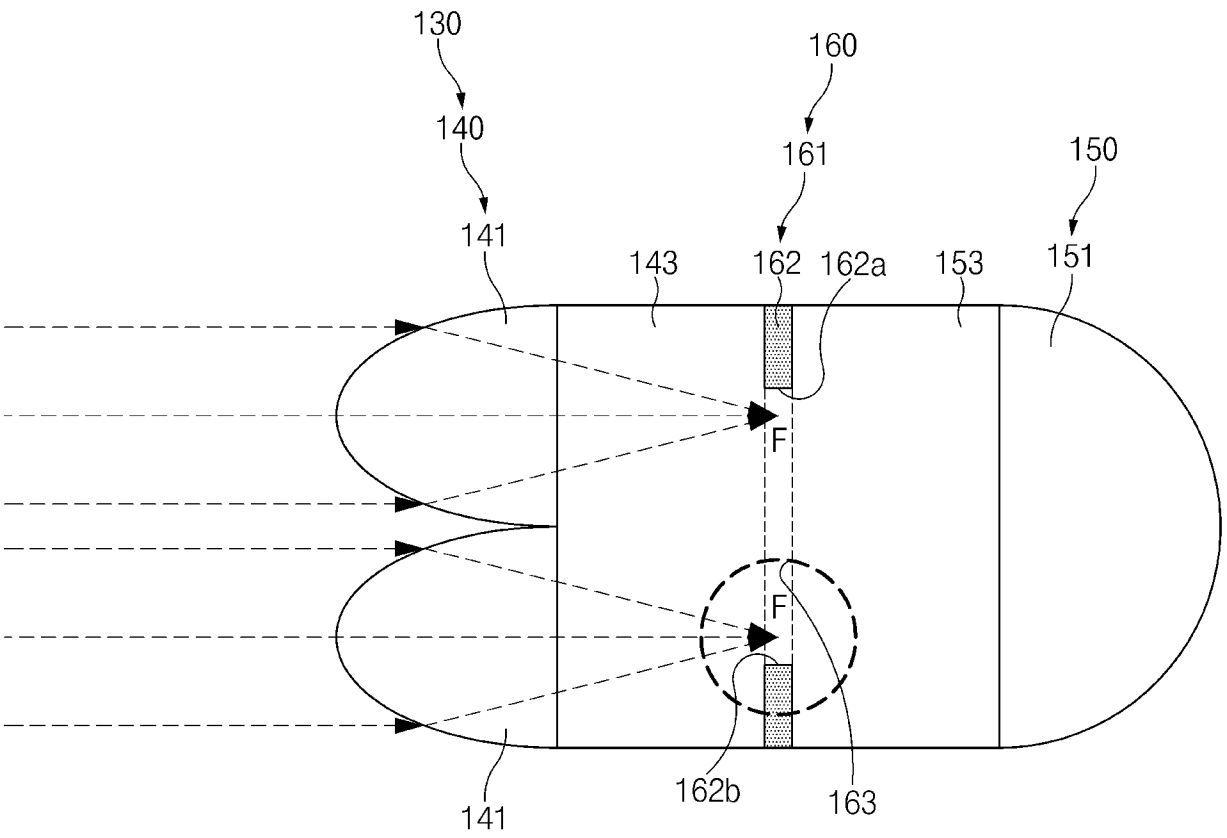
FIG. 6 is a cross-sectional view illustrating a vehicle lamp, according to the first embodiment of the present disclosure, which is an enlarged view illustrating a part of FIG. 3.
Figure 7:
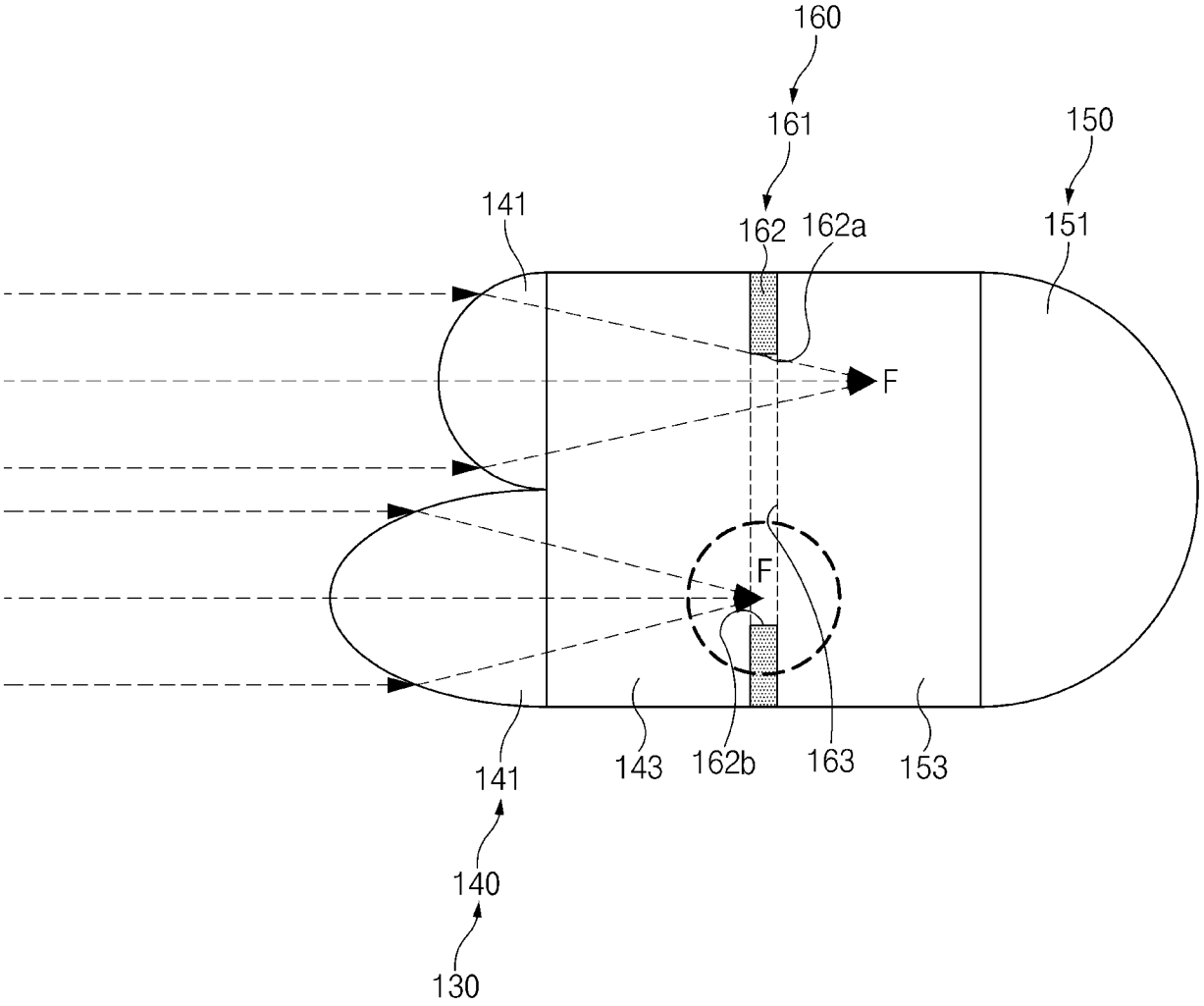
FIG. 7 is a cross-sectional view illustrating a vehicle lamp, according to a modification of the first embodiment of the present disclosure.
Figure 8A:
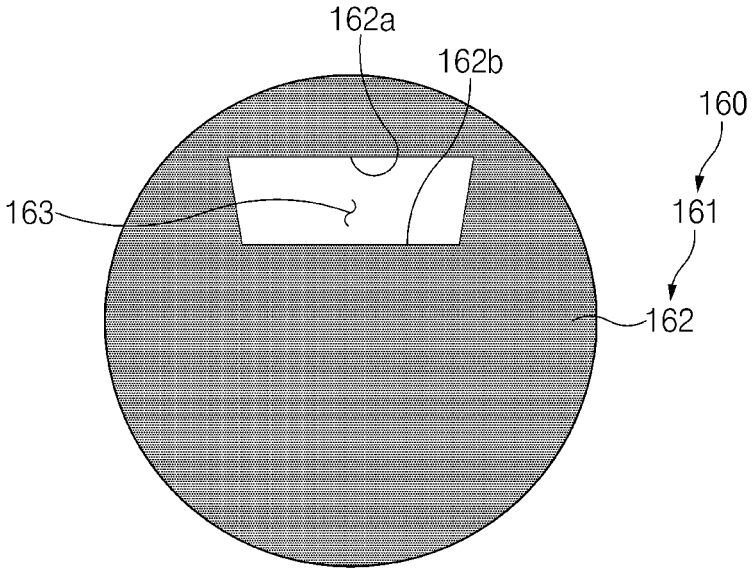
FIG. 8A is a view illustrating the central region of a lens array, that is, a unit mask disposed in a first region, according to the present disclosure.
Figure 8B:
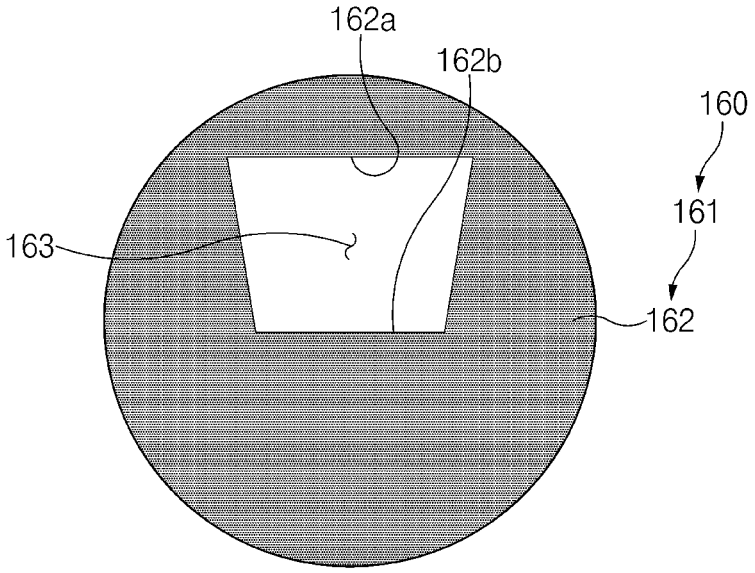
FIG. 8B is a view illustrating a unit mask interposed between the central region of a lens array and an edge region of the lens array, according to the present disclosure.
Figure 8C:
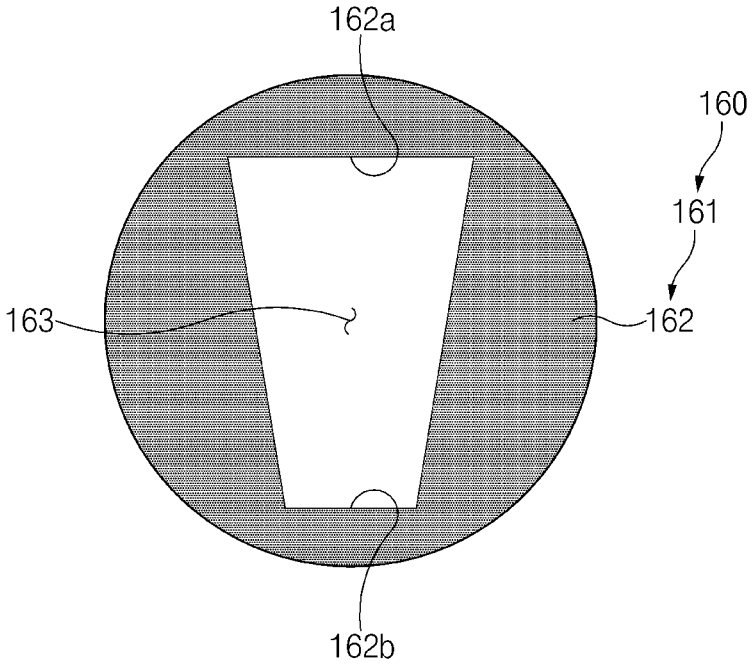
FIG. 8C is a view illustrating a unit mask disposed at an edge region of a lens array, according to the present disclosure.

FIGS. 1 to 8C illustrate a first embodiment of the present disclosure. FIG. 1 is a view illustrating that a vehicle lamp is mounted in a vehicle, according to a first embodiment of the present disclosure. FIG. 2 is a perspective view illustrating a vehicle lamp, according to the first embodiment of the present disclosure. FIG. 3 is a cross-sectional view illustrating a vehicle lamp, according to the first embodiment of the present disclosure. FIG. 4 is a front view illustrating a lens array, according to the first embodiment of the present disclosure. FIG. 5 is a view illustrating a unit mask of a shielding part, according to the first embodiment of the present disclosure. FIG. 6 is a cross-sectional view illustrating a vehicle lamp, according to the first embodiment of the present disclosure, which is an enlarged view illustrating a part of FIG. 3. FIG. 7 is a cross-sectional view illustrating a vehicle lamp, according to a modification of the first embodiment of the present disclosure. FIG. 8A is a view illustrating the central region of a lens array, that is, a unit mask disposed in a first region, according to the present disclosure. FIG. 8B is a view illustrating a unit mask interposed between the central region of a lens array and an edge region of the lens array, according to the present disclosure. FIG. 8C is a view illustrating a unit mask disposed at an edge region of a lens array, according to the present disclosure.

Referring to FIGS. 1 to 8C, according to a first embodiment of the present disclosure, the vehicle lamp 100 includes a light source device 110 and a lens array 130. In addition, according to a first embodiment of the present disclosure, the vehicle lamp 100 may further include a shielding part 160.

The light source device 110 is provided to generate and irradiate light. The lens array 130 is provided in front of the light source device 110 to output light, which is incident to the lens array 130 from the light source device 110, forward.

For example, the light source device 110 may be provided to irradiate light toward the road surface 2. The light source device 110 may include a light source 111 and a collimator 113. For example, the light source 111 may be, but is not limited to, a light emitting diode (hereinafter, an LED). The collimator 113 may convert light emitted from the light source 111 into light parallel to an optical axis and may allow the light to be incident into a first lens device 140.

The lens array 130 includes the first lens device 140 and a second lens device 150.

The first lens device 140 includes a plurality of first micro-lenses 141 to receive light incident thereto from the light source device 110. The second lens device 150 includes a plurality of second micro-lenses 151 provided to output the light incident from the first lens device 140.

For example, the first micro-lenses 141 may include incident surfaces which are convex toward the light source device 110, and the incident surfaces of the first micro-lenses 141 may form the whole incident surface of the first lens device 140. Alternatively, the second micro-lenses 151 may include output surfaces which are convex toward the road surface 2, and the output surfaces of the second micro-lenses 151 may form the whole output surface of the second lens device 150. However, the shapes of the first micro-lens 141 and the second micro-lens 151 are not limited to the above shapes.

For example, the first lens device 140 may further include a first light transmitting body 143. The first light transmitting body 143 has a surface facing the light source device 110, and the first micro-lens 141 is formed on the surface. The first light transmitting body 143 may include a material for transmitting light.

In addition, for example, the second lens device 150 may further include a second light transmitting body 153. The second micro-lens 151 is formed on a surface, which faces a direction opposite to a direction facing the first light transmitting body 143, to transmit light. In addition, the second light transmitting body 153 may be provided to face the first light transmitting body 143 while the shielding part 160 is interposed between the first light transmitting body 143 and the second light transmitting body 153.

The first light transmitting body 143 and the second light transmitting body 153 may serve as bodies for integrally forming the first lens device 140 and the second lens device 150. However, the present disclosure is not limited thereto. When the first lens device 140 and the second lens device 150 are not integrally formed, at least one of the first light transmitting body 143 and the second light transmitting body 153 may be omitted.

Meanwhile, the size of at least a portion of the first micro-lens 141 is smaller than the size of the second micro-lens 151, which is provided corresponding to the at least a portion of the first micro-lens 141, in a vertical direction.

In detail, when viewed from a rear portion of the lens array 130, the central region, through which the optical axis of the light source device 110 passes, of a partial region of the lens array 130 is referred to a first region 'I', and a region, which is provided around the first region 'I', of a remaining region of the lens array 130 is referred to as a second region 'II'. In this case, the size of the first micro-lens 141, which is provided in the second region 'II', may be smaller than the size of the second micro-lens 151 which is provided in the second region 'II' in the vertical direction.

In more detail, the sizes of the first micro-lens 141 and the second micro-lens 151 in the vertical direction may be formed to be equal to each other or to be approximate to each other, in the first region 'I' which is the central region representing the highest value in the brightness of light irradiated from the light source device 110, when viewed from an incident side of the first lens device 140.

In addition, the size of the first micro-lens 141 may be formed to be smaller than the size of the second micro-lens 151 in the vertical direction, in the second region 'II' serving as a peripheral region of the central region, which represents the lower value in the brightness of light irradiated from the light source device 110, when viewed from the incident side of the first lens device 140.

For example, according to an embodiment illustrated, in the second region 'II', the size of the size of the second micro-lens 151 may be twice larger than the size of the first micro-lens 141 in the vertical direction. However, the present disclosure is not limited thereto. For example, in the second region 'II', the size of the second micro-lens 151 may be at least three times larger than the size of the first micro-lens 141 in the vertical direction.

On the assumption that the thicknesses of the lenses are approximate to each other, the curvature of the lens may be increased when the size of the lens in the vertical direction is reduced, and a quantity of light incident through the lens may be increased, when the curvature of the lens may be increased. According to a first embodiment of the present disclosure, the first micro-lens 141 provided in the second region 'II' may be formed to have a smaller size in the vertical direction. Accordingly, a quantity of light incident through the first micro-lens 141 may be increased, in the second region 'II' showing the lower value in the luminous intensity of the light irradiated from the light source device 110

Accordingly, according to the present disclosure, the uniformity of a quantity of light incident to the whole region of the first lens device 140 may be improved. Accordingly, the uniformity of a beam pattern formed on the road surface 2 by the lens array 130 may be improved. Therefore, according to the present disclosure, the loss in the quantity of light is minimized. Accordingly, the uniformity of the beam pattern formed on the road surface 2 may be increased without employing the additional light source 111.

In this case, the curvature of the first micro-lens 141, which is provided in the second region 'II' may be larger than the curvature of the first micro-lens 141 which is provided in the first region 'I' in the vertical direction.

In detail, the first micro-lens 141 in the second region 'II' may be formed to have the radius of curvature smaller than the radius of curvature of the first micro-lens 141 in the first region 'I'. Accordingly, as the quantity of light incident through the first micro-lens 141 in the second region 11' is increased, the loss in the quantity of light may be minimized. Accordingly, the uniformity of the quantity of the light incident into the whole region of the first lens device 140 may be improved.

Meanwhile, the plurality of first micro-lenses 141 in the second region 'II' may be formed to be gradually reduced in size in the vertical direction, as the plurality of first micro-lenses 141 in the second region 'II' becomes away from the first region 'I'.

In detail, light radiated from the light source 111 and passing through the collimator 113 shows the highest luminous intensity in the central region of the first lens device 140, and shows the luminous intensity, which is gradually reduced away from the central region. The plurality of first micro-lenses 141 provided in the second region 'II' may be formed to have the size reduced in the vertical direction away from the central region. Accordingly, a quantity of light incident through the first micro-lenses 141 provided in the second region 'II' may be increased.

Meanwhile, the shielding part 160 may be interposed between the first lens device 140 and the second lens device 150 to shield a portion of light incident from the first lens device 140 to the second lens device 150, such that a specific beam pattern may be formed on the road surface 2.

In detail, the shielding part 160 may include a unit mask 161. A plurality of unit masks 161 may be provided to correspond to a plurality of second micro-lenses 151, respectively. The unit mask 161 may have a masking pattern for forming a beam pattern. In other words, the unit masks 161 may be provided to correspond to the second micro-lenses 151, which are disposed at an output side of the lens array 130, respectively.

In more detail, the unit mask 161 may include a shielding region 162 provided to shield light, and a light transmitting region 163 provided to transmit light and having a shape corresponding to a masking pattern. The image of the beam pattern projected on the road surface 2 may be varied depending on the shape of the light transmitting region 163, that is, the shape of the masking pattern For example, the unit mask 161 may be provided in the form of a plate and may form a specific beam pattern, as the light is masked in the shielding region 162.

Meanwhile, hereinafter, on a beam pattern, a direction, in which the beam pattern is away from the vehicle lamp 100, is defined as a longer distance direction, and a direction opposite to the longer distance direction is defined as a shorter distance direction.

A plurality of first micro-lenses 141 may be provided to correspond to one second micro-lens 151 in the second region 'II'.

The shielding region 162 may include a longer distance edge **162*b* provided to make contact with an end portion of the light transmitting region 163 while forming an end line in the longer distance direction of the beam pattern, and a shorter distance edge 162*a* provided to face the longer distance edge 162*b* while forming an end line in a shorter distance direction of the beam pattern. For example, according to an embodiment illustrated, the longer distance edge 162*b* may make contact with an upper end of the light transmitting region 163, and the shorter distance edge 162*a* may make contact with a lower end of the light transmitting region 163**.

In this case, a focus F of the first micro-lens 141, which forms a beam pattern at the longest distance, of the plurality of first micro-lenses 141 corresponding to one second micro-lens 151 may be formed at a position corresponding to the longer distance edge 162*b*. For example, referring to FIG. 6, the first micro-lens 141, which is placed at an upper portion of the first micro-lenses 141 in the vertical direction, may form a beam pattern at a longer distance. In addition, the focus F of the first micro-lens 141 placed at the upper portion may be positioned to be adjacent to the longer distance edge 162*b*.

As described above, as the focus F of the first micro-lens 141 is positioned at the longer distance edge 162*b*, a point showing the maximum luminous intensity of the first micro-lens 141 is positioned at the longer distance edge 162*b*. Accordingly, as the brightness of the beam pattern is increased at the longer distance region, the uniformity of the beam pattern may be improved.

However, as illustrated in FIG. 6, when the first micro-lens 141 placed at the upper portion and the second micro-lens 141 placed at the lower portion have the same curvature, a point showing the maximum luminous intensity of the first micro-lens 141 is positioned even at the shorter distance edge 162*a*. In this case, a pattern at a longer distance and a pattern at a shorter distance may be not uniform.

As illustrated in FIG. 7, a curvature of the first micro-lens 141, which forms a beam pattern at the longest distance, of the first micro-lenses 141 corresponding to the one second micro-lenses 151, in the vertical direction may be formed to be greater than a curvature of remaining first micro-lenses 141 of the first micro-lenses 141 corresponding to the one second micro-lenses 151 in the vertical direction.

Accordingly, as the radius of curvature of the first micro-lens 141, which irradiates light to the shorter distance region, is more increased, a light concentration rate may be lowered. Therefore, as the brightness of the shorter distance region and the brightness of the longer distance region are uniform on the beam pattern, the uniformity of the pattern may be improved.

In addition, referring to FIG. 7, the focus F of the first micro-lens 141, which forms the beam pattern in the longest distance direction, may be provided to be positioned inside the light transmitting region 163.

In addition, the focus F of the remaining first micro-lens 141 other than the first micro-lens 141 forming the beam pattern in the longest distance direction may be provided to be positioned at spaced points in front or back of the light transmitting region 163

Accordingly, the brightness of the longer distance region and the brightness of the shorter distance region are uniform on the beam pattern, thereby improving the uniformity of the pattern.

Meanwhile, FIG. 8A is a view illustrating a unit mask 161 disposed in the central region, that is, the first region "I", of the lens array 130, according to the present disclosure. FIG. 8C is a view illustrating a unit mask 161 disposed at an edge region of the lens array 130, according to the present disclosure. FIG. 8B is a view illustrating a unit mask 161 disposed between the central region and the edge region of the lens array 130, according to the present disclosure.

Referring to FIGS. 8A to 8C, a plurality of unit masks 161 may be formed to include a light transmitting region 163 having a size which is gradually increased farther away from the central portion, through which an optical axis passes, of the light source device 110.

In detail, light incident to the first lens device 140 through the collimator 113 may have the highest luminous intensity at the central portion of the first lens device 140. In addition, as the size of the light transmitting region 163 of the unit mask 161 is increased, the brightness of the beam pattern may be increased. According to the present disclosure, the unit mask 161 may be formed to include the light transmitting region 163 having a size increased toward the edge of the lens array 130 from the central portion of the lens array 130, thereby improving light uniformity of a beam pattern irradiated onto the road surface 2.

In this case, unit masks 161, which are adjacent to each other toward the edge of the lens array 130 from the central portion of the lens array 130, may be formed to include light transmitting regions 163 having the sizes making the difference within a specific size (for example, about 1 mm). Accordingly, since the quantity of light is not sharply changed between pattern regions corresponding to the unit masks 161 adjacent to each other, the pattern disconnection resulting from the change in the quantity of light may be prevented in advance.

Meanwhile, on a beam pattern, a direction, in which the beam pattern is away from the vehicle lamp 100, is defined as a longer distance direction, and a direction opposite to the longer distance direction is defined as a shorter distance direction.

In this case, the shielding region 162 may include a longer distance edge 162*b* provided to make contact with an end portion of the light transmitting region 163 while forming an end line in the longer distance direction of the beam pattern, and a shorter distance edge 162*a* provided to face the longer distance edge 162*b* while forming an end line in a shorter distance direction of the beam pattern.

In addition, a plurality of unit masks 161 may be formed to include a light transmitting region 163 having a size which is gradually increased, by increasing the distance between the longer distance edge 162*b* and the shorter distance edge 162*a*, farther away from the central portion, through which an optical axis passes, of the light source device 110.

In addition, for example, the shorter distance edge 162*a* formed in each of the plurality of unit masks 161 may have an equal width in a left-right direction.

Accordingly, the size of the light transmitting region 163 may be adjusted by making the position and the size of the shorter distance edge 162*a* uniform and changing the position and the size of the longer distance edge 162*b*, on each unit mask 161.

In this case, the ratio of the longer distance edge 162*b* to the shorter distance edge 162*a* in the shielding region 162 may be greater than the ratio of the end line provided in the longer distance direction to the end line provided in the shorter distance direction. For example, when the beam pattern formed on the road surface 2 has the shape of a rectangle, the width of the longer distance edge 162*b* in the left-right direction may be greater than the width of the shorter distance edge 162*a*, which faces the longer distance edge 162*b*, in the left-right direction. In other words, when the beam pattern has the shape of the rectangle, the light transmitting region 163 may be formed in the shape of a trapezoid.

As described above, according to the first embodiment of the present disclosure, in the vehicle lamp, the uniformity of the quantity of light incident to the whole region of the first lens device may be improved. Accordingly, the uniformity of the beam pattern formed on the road surface may be improved by the lens array.

According to an embodiment of the present disclosure, the loss in the quantity of light is minimized. Accordingly, the uniformity of the beam pattern formed on the road surface may be increased without employing the additional light source.

Second Embodiment

Figure 9:
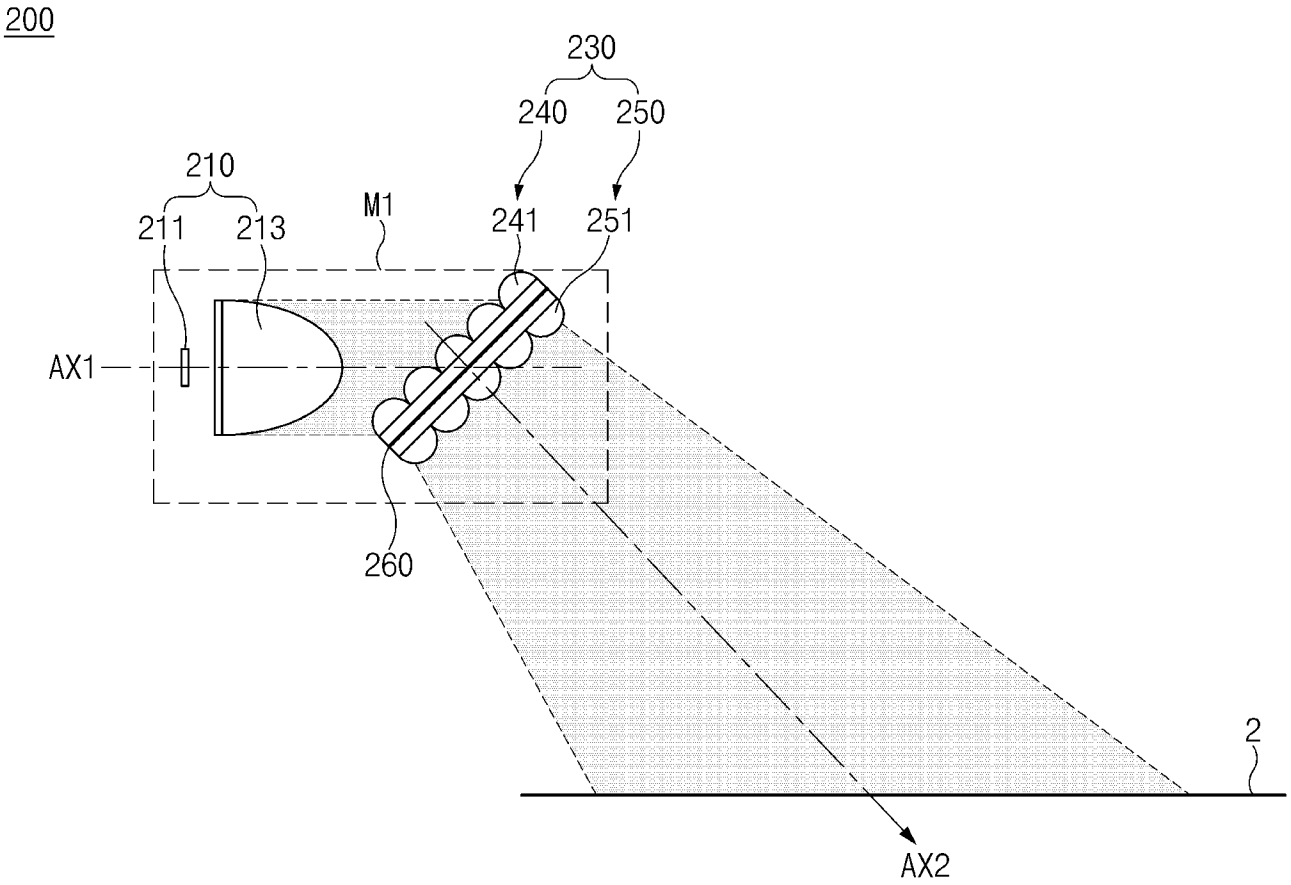
FIG. 9 is a view schematically illustrating a vehicle lamp, according to a second embodiment of the present disclosure.
Figure 10:
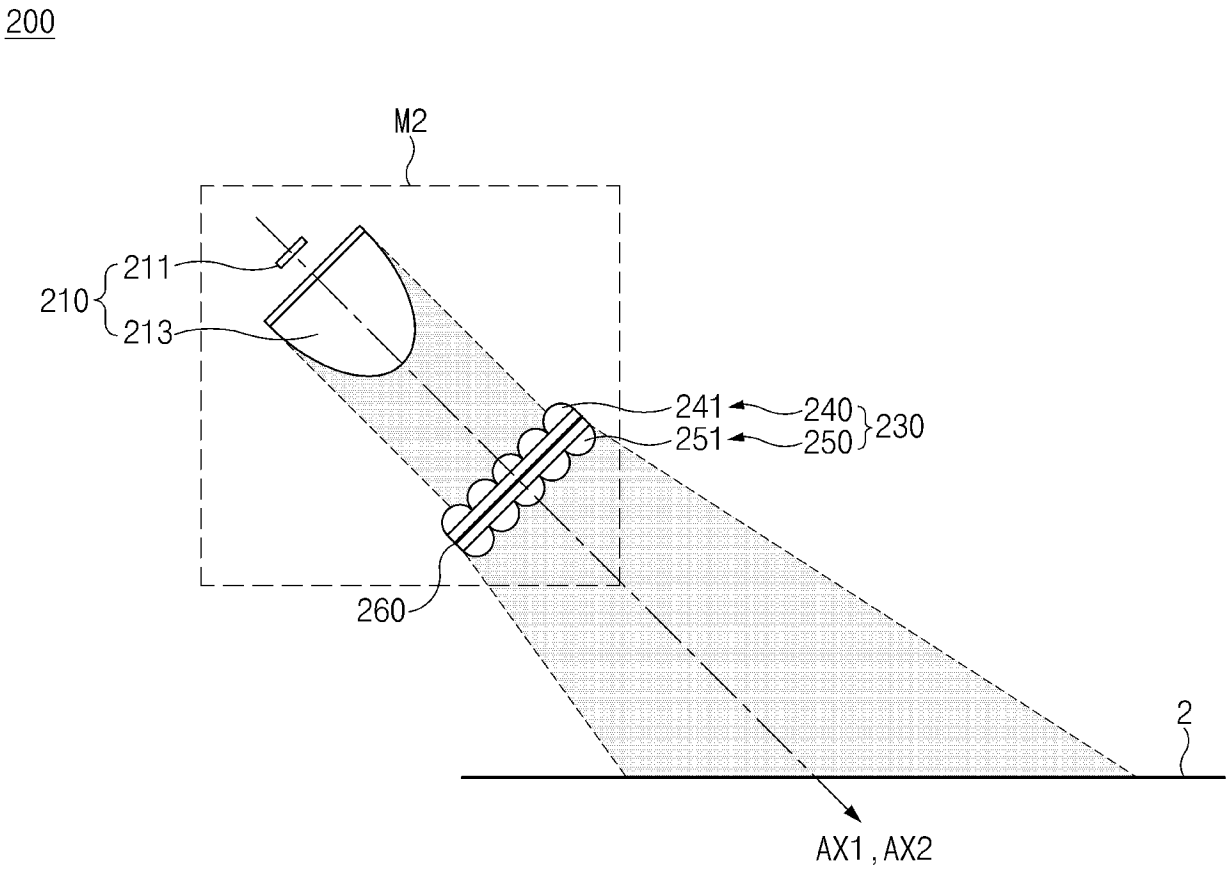
FIG. 10 is a view schematically illustrating a vehicle lamp, according to a comparative example of the present disclosure.
Figure 11:
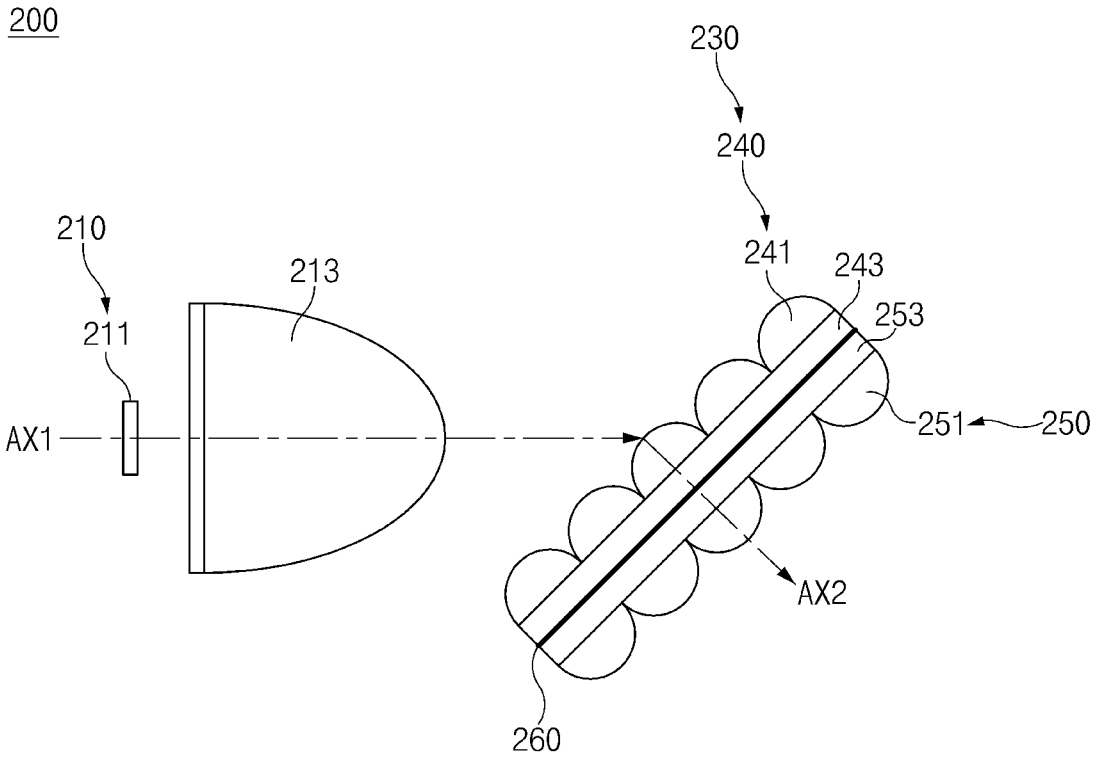
FIG. 11 is a cross-sectional view illustrating a vehicle lamp, according to the second embodiment of the present disclosure.
Figure 12:
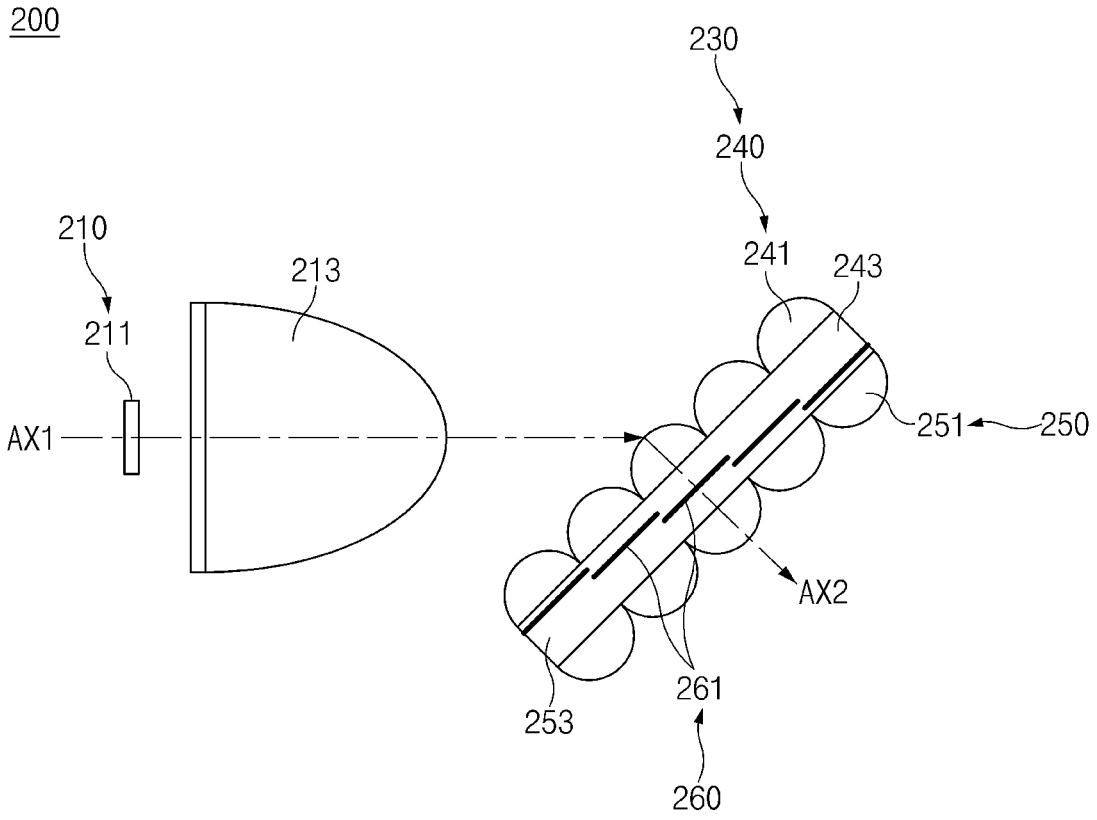
FIG. 12 is a view illustrating a vehicle lamp, according to a modification of the second embodiment of the present disclosure.
Figure 13:
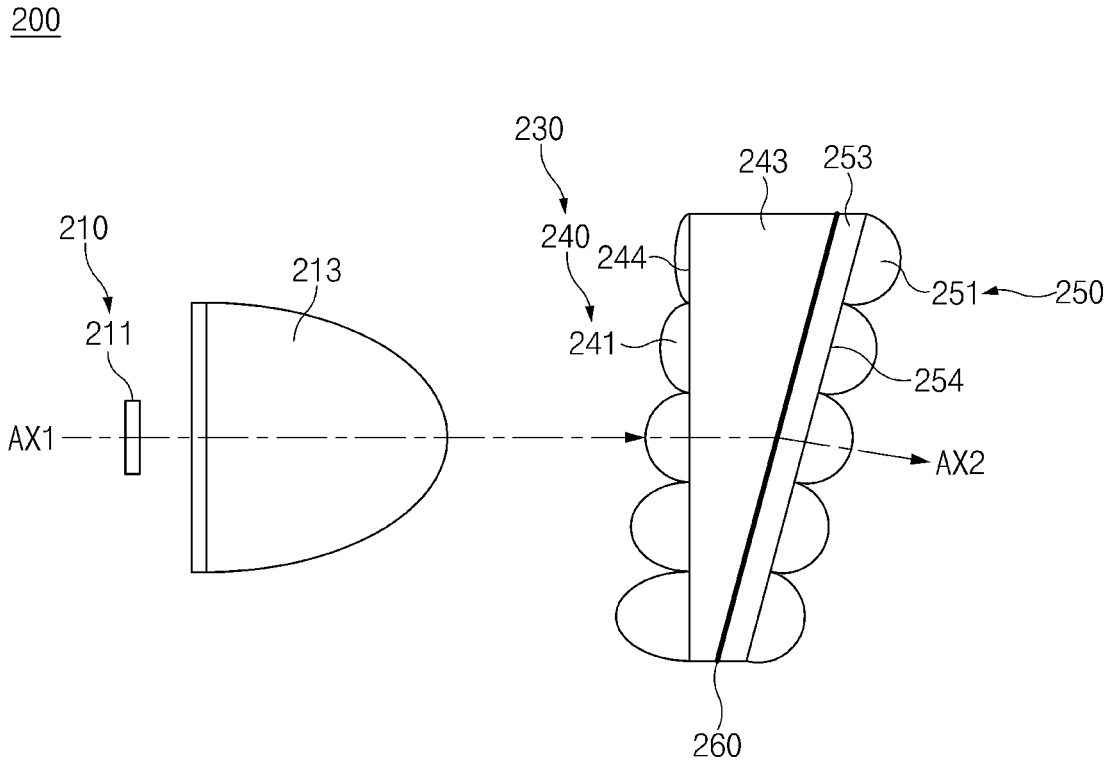
FIG. 13 is a view illustrating a vehicle lamp, according to another modification of the second embodiment of the present disclosure.
Figure 14:
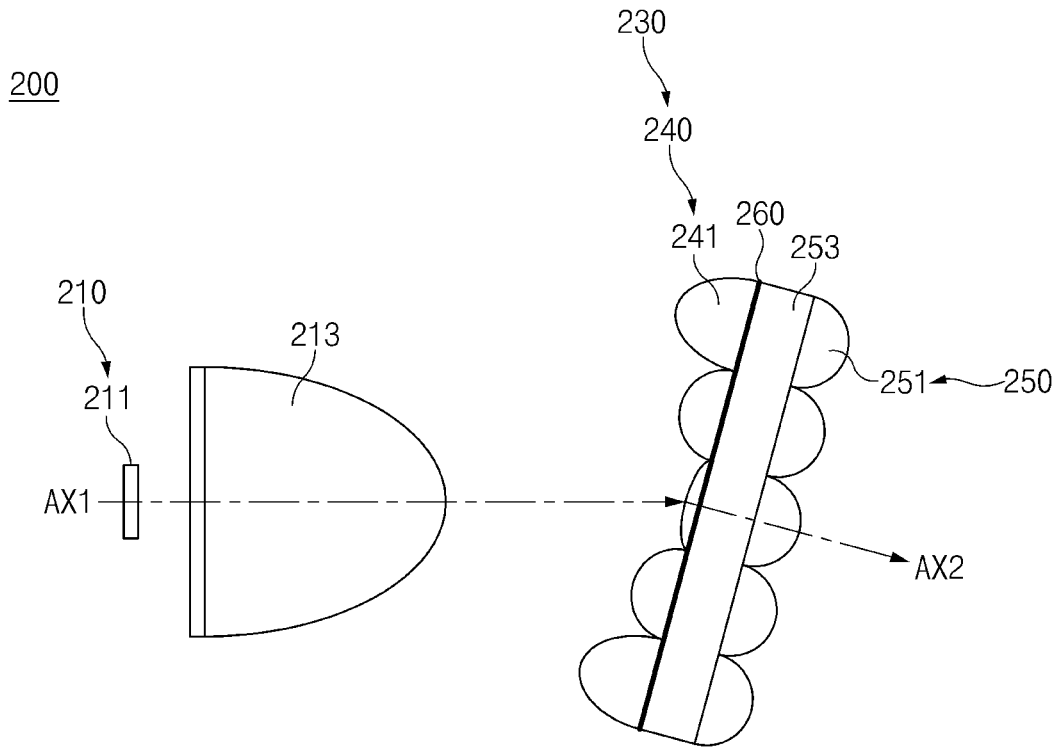
FIG. 14 is a sectional view illustrating a vehicle lamp, according to another modification of the second embodiment of the present disclosure.

FIGS. 9 to 14 illustrate a second embodiment of the present disclosure. FIG. 9 is a view schematically illustrating a vehicle lamp, according to a second embodiment of the present disclosure. FIG. 10 is a view schematically illustrating a vehicle lamp, according to a comparative example of the present disclosure. FIG. 11 is a side view illustrating a vehicle lamp, according to a second embodiment of the present disclosure. FIG. 12 is a side view illustrating a vehicle lamp, according to a modification of the second embodiment of the present disclosure. FIG. 13 is a side view illustrating a vehicle lamp according to another modification of the second embodiment of the present disclosure. FIG. 14 is a side view illustrating a vehicle lamp, according to still another modification of the second embodiment of the present disclosure.

Referring to FIGS. 9 to 14, according to a second embodiment of the present disclosure, the vehicle lamp 200 includes a light source device 210 and a lens array 230. In addition, according to a second embodiment of the present disclosure, the vehicle lamp 200 may further include a shielding part 260.

The light source device 210 is provided to generate and irradiate light. The lens array 230 is provided in front of the light source device 210 to output light, which is incident to the lens array 230 from the light source device 210, forward.

For example, the light source device 210 may be provided to irradiate light toward the road surface 2. The light source device 210 may include a light source 211 and a collimator 213. For example, the light source 211 may be, but is not limited to, a light emitting diode (hereinafter, an LED). The collimator 213 may convert light emitted from the light source 211 into light parallel to an optical axis and may allow the light to be incident into a first lens device 240.

The lens array 230 includes the first lens device 240 and a second lens device 250.

The first lens device 240 includes a plurality of first micro-lenses 241 to receive light incident thereto from the light source device 210. The second lens device 250 includes a plurality of second micro-lenses 251 provided to output the light incident from the first lens device 240.

For example, the first micro-lenses 241 may include incident surfaces which are convex toward the light source device 210, and the incident surfaces of the first micro-lenses 241 may form the whole incident surface of the first lens device 240. Alternatively, the second micro-lenses 251 may include output surfaces 254 which are convex toward the road surface 2, and the output surfaces 254 of the second micro-lenses 251 may form the whole output surface 254 of the second lens device 250. However, the shapes of the first micro-lens 241 and the second micro-lens 251 are not limited to the above shapes.

For example, the first lens device 240 may further include a first light transmitting body 243. The first light transmitting body 243 has a surface facing the light source device 210, and the first micro-lens 241 is formed on the surface. The first light transmitting body 143 may include a material for transmitting light.

For example, the second lens device 250 may further include a second light transmitting body 253. The second micro-lens 251 is formed on a surface, which faces a direction opposite to a direction facing the first light transmitting body 243, to transmit light. In addition, a second light transmitting body 253 may be provided to face the first light transmitting body 243 while the shielding part 260 is interposed between the first light transmitting body 243 and the second light transmitting body 253.

The first light transmitting body 243 and the second light transmitting body 253 may serve as bodies for integrally forming the first lens device 240 and the second lens device 250. However, the present disclosure is not limited thereto. When the first lens device 240 and the second lens device 250 are not integrally formed, at least one of the first light transmitting body 243 and the second light transmitting body 253 may be omitted.

Meanwhile, referring to FIG. 9, on the assumption that an optical axis of light, which is output from the light source device 210 and incident toward the first lens device 240, is referred to as a first optical axis AX1, and an optical axis of light, which is output from the second lens device 250, is referred to as a second optical axis AX2, the lens array 230 is formed such that the second optical axis AX2 is tilted toward the road surface 2 about the first optical axis AX1. In this case, the first optical axis AX1, which is an optical axis of light incident toward the first lens device 240, may be an optical axis of light output from the light source device 210.

In detail, the lens array 230 may be formed such that the first axis AX1 serving as an optical axis of the light incident toward the first lens device 240 is formed at an angle different from an angle of the second optical axis AX2 serving as the optical axis of the light output from the second lens device 250. For example, the first optical axis AX1 may extend in parallel to the road surface 2, that is, in a longitudinal direction of the vehicle 1. The second optical axis AX2 extends toward the road surface 2 from the second lens device 250, such that the second optical axis AX2 is titled about the first optical axis AX1.

Therefore, according to the present disclosure, when light is irradiated and tilted about the road surface 2 through a vehicle lamp 200, an entire portion of the light source device 210 and the lens array 230 are not mounted to be tilted toward the road surface 2, but only the second optical axis AX2 of the second lens device 250 is formed to be tilted such that a beam pattern is formed on the road surface 2. In this case, since the size M1 of the lens array 230 is reduced, the vehicle lamp 200 in a smaller size may be realized.

FIG. 10 is a view illustrating a comparative example of the present disclosure. For the convenience of explanation, the reference numerals of the comparative example of the present disclosure are the same as reference numerals of FIG. 9 according to the present disclosure. According to the comparative example, when the entire portion of the light source device 210 and the lens array 230 are mounted to be tilted toward the road surface 2, the size M2 of the vehicle lamp 200, particularly, the height of the vehicle lamp 200 in the vertical direction is increased. Accordingly, the space occupied by the vehicle lamp 200 inside the vehicle 1 may be widened. Meanwhile, as illustrated in FIG. 9, according to an embodiment of the present disclosure, as only the second optical axis AX2 of the second lens device 250 is formed to be titled, the vehicle lamp 200 in a smaller size may be realized. Accordingly, the space occupied by the vehicle lamp 200 may be reduced.

In this case, various manners may be, without limitation, employed to form the second optical axis AX2 of the second lens device 250, such that the second optical axis AX2 is tilted about the first optical axis AX1.

For example, referring to FIG. 11, the lens array 230 is formed to be titled about a plane perpendicular to the first optical axis AX1, such that the second optical axis AX2 forms a specific angle about the first axis AX1. In this case, all of the first micro-lens 241, the first light transmitting body 243, the shielding part 260, the second light transmitting body 253, and the second micro-lens 251 may be placed to be tilted about the first optical axis AX1.

Accordingly, the optical axis AX2 provide in the second lens device 250 may extend in a direction tilted about the first optical axis AX1.

However, in this case, as the lens array 230 is titled, incident light may have various incident angles throughout the entire region of the first lens device 240. In particular, the difference in incident angle may be made between an upper portion of the first lens device 240 and a lower portion of the first lens device 240. Accordingly, a quantity of light and a resolution may be varied throughout the entire region of the lens array 230. Accordingly, the second optical axis AX2 is tilted about the first optical axis AX1 while extending toward the road surface 2.

According to the present disclosure, optical performance may be complemented by changing the form of the shielding part 260, the second light transmitting body 253, and the second micro-lens 251.

For example, referring to FIG. 2, the shielding part 260 may be interposed between the first lens device 240 and the second lens device 250 to shield a portion of light incident from the first lens device 240 toward the second lens device 250, such that a specific beam pattern may be formed on the road surface 2.

In addition, the shielding part 260 may further include a unit mask 261. A plurality of unit masks 261 may be provided to correspond to a plurality of second micro-lenses 251, respectively, and a masking pattern may be formed to form a beam pattern.

The plurality of unit masks 261 may be placed to be away from the second micro-lenses 251 toward the lower portion of the lens array 230.

For example, the focus of each of the second micro-lenses 251 may be positioned on each unit mask 261. In addition, as the plurality of unit masks 261 are arranged, the focus of the second micro-lenses 151 may be elongated toward the lower portion of the lens array 230.

Accordingly, as the focal length of the second micro-lenses 151 is increased toward the lower portion of the lens array 230. Accordingly, as the lens array 230 is titled, the difference in resolution between regions may be corrected.

In addition, the radius of curvature of the plurality of second micro-lenses 151 may be formed to be gradually increased toward the lower portion of the lens array 230.

Accordingly, the focal length of the second micro-lenses 151 may be increased toward the lower portion of the lens array 230. Accordingly, as the lens array 230 is tilted, the difference in resolution between regions may be corrected.

Meanwhile, referring to FIG. 13, an incident surface 244, which is a surface, which faces the light source device 210 of the first light transmitting body 243, may be formed to be perpendicular to the first optical axis AX1. In addition, an output surface 254, which is a surface, which faces a direction opposite to a direction facing the light source device 210, of the second light transmitting body 253 may be formed to be tilted about the incident surface 244, such that the output surface 254 is closer to the incident surface 244 toward a lower portion of the lens array 230.

In addition, the shielding part 260 may be provided in parallel to the output surface 254

In this case, the second light transmitting body 253 and the assembly with the second light transmitting body 253 have the shape of a trapezoid having a size gradually reduced downward. Accordingly, the second optical axis AX2 of the second micro-lenses 251 may be tilted about the first axis AX1 without tilting the lens array 230. In other words, since the first lens device 240 is not tilted about the first axis AX1, the light loss resulting from the difference between incident angles may be minimized.

In addition, the radius of curvature of the plurality of first micro-lenses 241 may be formed to be gradually reduced downward.

In detail, as illustrated in FIG. 13, according to an embodiment, the shielding part 260 and the second micro-lenses 251 are tilted about the first axis AX1. Accordingly, the distance between the first micro-lens 241 and the shielding part 260 may be gradually reduced downward. In other words, the difference in distance between the first micro-lens 241 and the shielding part 260 is varied throughout the entire portion of the lens array 230 to cause the difference in quantity of light. Accordingly, the radius of curvature of the first micro-lens 241 may be formed to be gradually reduced downward to correct the difference in quantity of light caused by the difference in distance between the first micro-lens 241 and the shielding part 260

Meanwhile, referring to FIG. 14, the shielding part 260 may be provided to be closer to the first micro-lens 241, rather than the second micro-lenses 251. For example, according to an embodiment illustrated, although the shielding part 260 may be directly attached to the first micro-lens 241, the position of the shielding part 260 is not limited thereto.

As described above, when the shielding part 260 may be provided to be adjacent to the first micro-lens 241 or to make close contact with the first micro-lens 241, the focal length of the second micro-lenses 251 is increased throughout the entire portion of the lens array 230 to correct the resolution.

In addition, according to an embodiment illustrated in FIG. 14, the plurality of first micro-lenses 241 may have a radius of curvature gradually reduced, farther away from the central portion, through which the first optical axis AX1 passes, when viewed the lens array 230.

In detail, as light incident from the light source device 210 to the first lens device 240 is farther away from the central portion, the light loss may be caused. Accordingly, the difference in luminous intensity may be made between beam patterns formed on the road surface 2. According to an embodiment of the present disclosure, as the radius of curvature of the plurality of first micro-lenses 241 is away from the central portion, the radius of curvature of the first micro-lenses 241 is gradually reduced. Accordingly, a quantity of light is increased at an outer region of the first lens device 240 to correct the light loss. Accordingly, the uniformity of the beam pattern formed on the road surface 2 may be improved.

As described above, according to a second embodiment of the present disclosure, the vehicle lamp may minimize the size of the lens array, even through a lamp which irradiates light on a road surface and titles the light about the road surface. Accordingly, the vehicle lamp in a smaller size may be realized.

Third Embodiment

Figure 15:
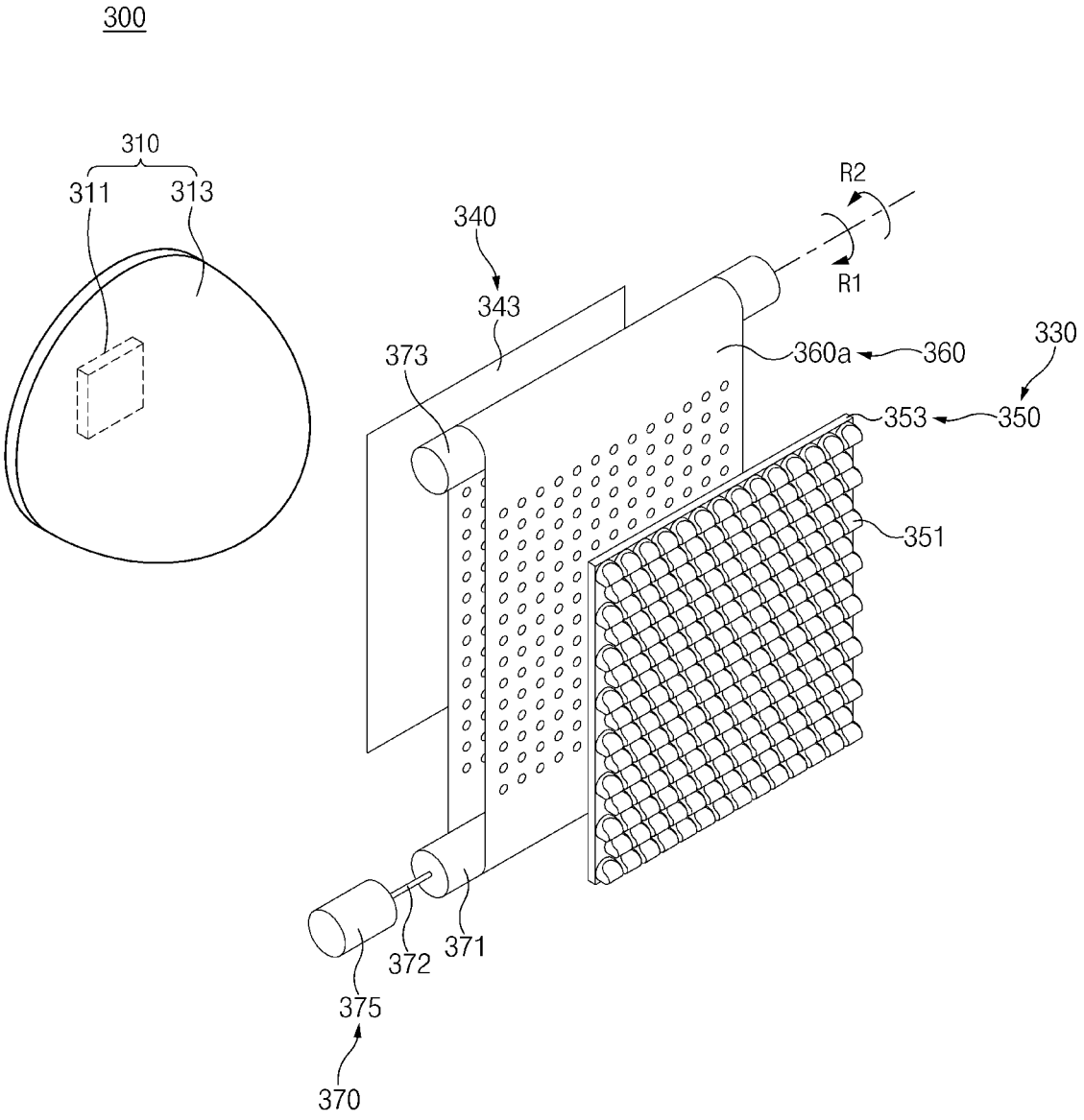
FIG. 15 is an exploded perspective view illustrating a vehicle lamp, according to a third embodiment of the present disclosure.
Figure 16:
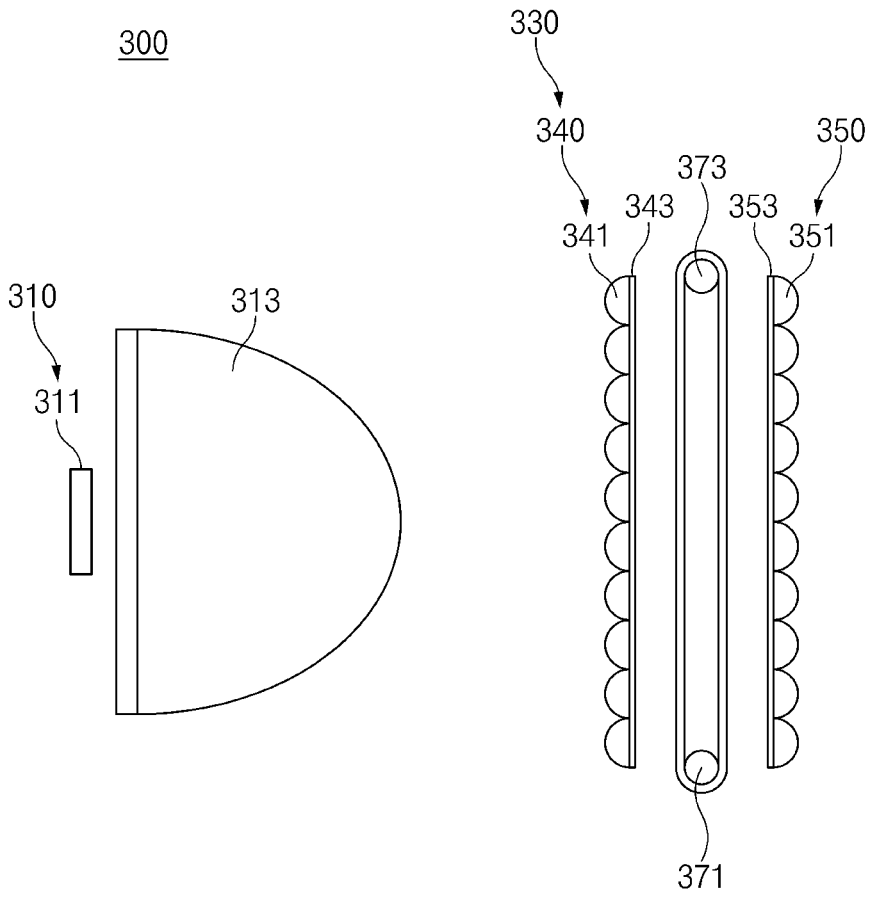
FIG. 16 is a cross-sectional view illustrating a vehicle lamp of FIG. 15, according to the third embodiment of the present disclosure.
Figure 17:
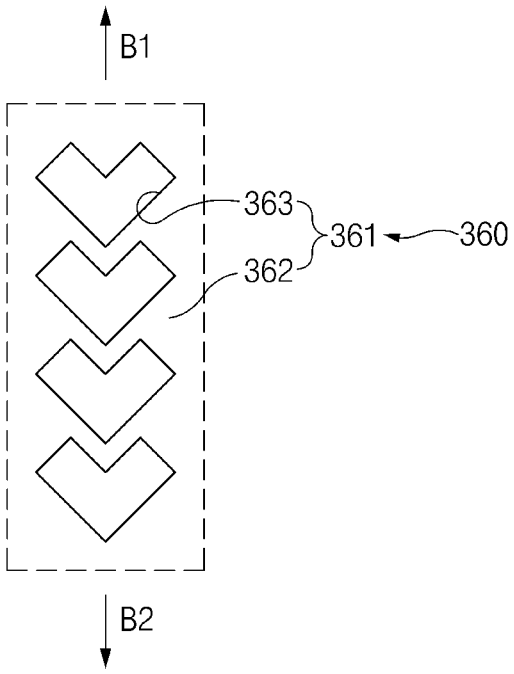
FIG. 17 is a view illustrating a unit mask formed in a shielding body of FIG. 16.
Figure 18A:
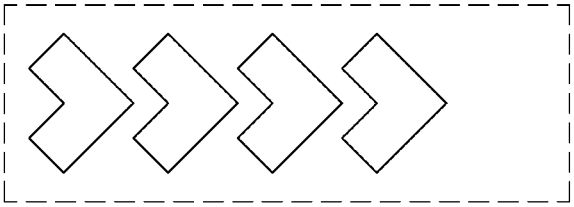
FIGS. 18A to 18D illustrate beam patterns projected to a road surface.
Figure 18B:
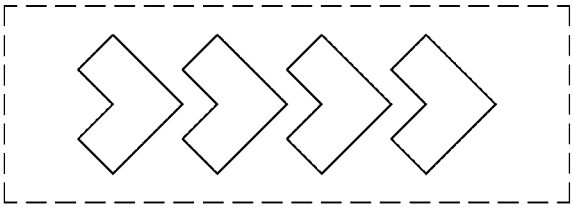
Figure 18C:
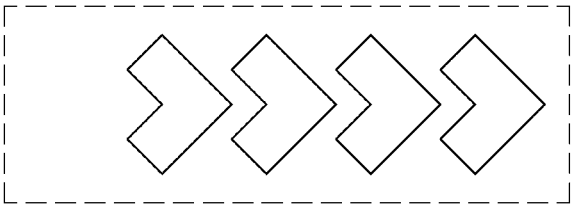
Figure 18D:
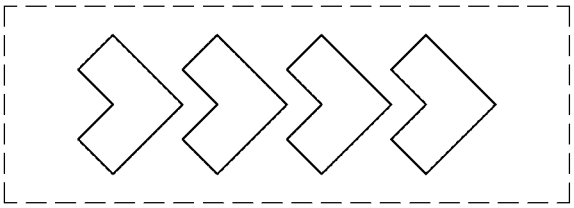

FIGS. 15 to 18 illustrate a third embodiment of the present disclosure. FIG. 15 is an exploded perspective view of a vehicle lamp, according to a third embodiment of the present disclosure. FIG. 16 is a side view of FIG. 15, which illustrates a vehicle lamp according to the third embodiment of the present disclosure. FIG. 17 is a view illustrating a unit mask formed in a shielding body of FIG. 16. FIGS. 18A to 18D illustrate beam patterns projected to a road surface.

Referring to FIGS. 15 to 18, according to a third embodiment of the present disclosure, the vehicle lamp 300 includes a light source device 310 and a lens array 330. In addition, according to the third embodiment of the present disclosure, the vehicle lamp 300 may further include a shielding part 360.

The light source device 310 is provided to generate and irradiate light. The lens array 330 is provided in front of the light source device 310 to output light, which is incident to the lens array 330 from the light source device 310, forward.

For example, the light source device 310 may be provided to irradiate light toward the road surface 2. The light source device 310 may include a light source 311 and a collimator 313. For example, the light source 311 may be, but is not limited to, a light emitting diode (hereinafter, an LED). The collimator 313 may convert light emitted from the light source 311 into light parallel to an optical axis and may allow the light to be incident to the first lens device 340.

The lens array 330 includes a first lens device 340 and a second lens device 350.

The first lens device 340 includes a plurality of first micro-lenses 341 to receive light incident thereto from the light source device 310. The second lens device 350 includes a plurality of second micro-lenses 351 provided to output the light incident from the first lens device 340.

For example, the first micro-lenses 341 may include incident surfaces which are convex toward the light source device 310, and the incident surfaces of the first micro-lenses 341 may form the whole incident surface of the first lens device 340. Alternatively, the second micro-lenses 351 may include output surfaces which are convex toward the road surface 2, and the output surfaces of the second micro-lenses 351 may form the whole output surface of the second lens device 350. However, the shapes of the first micro-lens 341 and the second micro-lens 351 are not limited to the above shapes.

For example, the first lens device 340 may further include a first light transmitting body 343. The first light transmitting body 343 has a surface facing the light source device 310, and the first micro-lens 341 is formed on the surface. The first light transmitting body 143 may include a material for transmitting light.

For example, the second lens device 350 may further include a second light transmitting body 353. The second micro-lenses 351 is formed on a surface, which faces a direction opposite to a direction facing the first light transmitting body 343, to transmit light. In addition, the second light transmitting body 353 may be provided to face the first light transmitting body 343 while the shielding part 360 is interposed between the first light transmitting body 343 and the second light transmitting body 353.

The first light transmitting body 343 and the second light transmitting body 353 may serve as bodies for integrally forming the first lens device 340 and the second lens device 350. However, the present disclosure is not limited thereto. When the first lens device 340 and the second lens device 350 are not integrally formed, at least one of the first light transmitting body 343 and the second light transmitting body 353 may be omitted.

Meanwhile, the shielding part 360 may be interposed between the first lens device 340 and the second lens device 350 to shield a portion of light incident from the first lens device 340 to the second lens device 350, such that a specific beam pattern may be formed on the road surface 2.

In detail, the shielding part 360 may include a unit mask 361. A plurality of unit masks 361 may be provided to correspond to a plurality of second micro-lenses 351, respectively. The unit mask 161 may have a masking pattern for forming a beam pattern. In other words, the unit masks 361 may be provided to correspond to the second micro-lenses 351, which are disposed at an output side of the lens array 330, respectively.

In more detail, the unit mask 361 may include a shielding region 362 provided to shield light, and a light transmitting region 363 provided to transmit light and having a shape corresponding to a masking pattern. The image of the beam pattern projected on the road surface 2 may be varied depending on the shape of the light transmitting region 363, that is, the shape of the masking pattern For example, the unit mask 361 may be provided in the form of a plate and may form a specific beam pattern, as the light is masked in the shielding region 362.

Alternatively, the shielding part 360 may be provided to be movable to change a lamp image of the beam pattern formed on the road surface 2.

In detail, a masking pattern for determining the image of the beam pattern to be projected on the road surface 2 is formed in a shielding body **360*a* of the shielding part 360. Accordingly, when light is irradiated from the vehicle lamp 300 to the road surface 2, and when the shielding body 360*a* is moved, the image of the beam pattern may be changed. Accordingly, the beam pattern may be changed to a dynamic image. Alternatively, as the shielding body 360*a* is provided to be movable, the shielding part 360 may make a beam pattern, which is formed when the vehicle lamp 300 is turned on, different whenever the vehicle lamp 300** is turned on.

Therefore, according to a third embodiment of the present disclosure, the beam pattern formed on the road surface 2 is realized in the form of a dynamic image, thereby producing an effect of changing the attention of a counterpart driver, such that visibility is improved.

In addition, according to a third embodiment of the present disclosure, the beam pattern is realized in the form of a dynamic image, thereby allowing a counterpart driver or a person around the vehicle 1 to intuitively acquire information on a forward direction of the vehicle 1, when the information on the forward direction of the vehicle 1 is notified to the counterpart driver or the person around the vehicle 1.

In addition, according to a first embodiment of the present disclosure, the vehicle lamp 300 may further include a driving device 370. The driving device 370 may provide driving force such that the shielding part 360 is movable.

In detail, the display device 370 may include a pair of rollers 371 and 373 and an actuator 375.

The pair of rollers 371 and 373 may be spaced apart from each other in the vertical direction, and may have a portion of outer surfaces thereof provided to make close contact with the shielding body **360*a***.

In this case, the pair of rollers 371 and 373 may be provided in parallel to each other and may be provided at an upper end portion and a lower end portion of the shielding body **360*a*, respectively. However, the arrangement of the rollers 371 and 373** is not limited thereto.

In detail, the shielding body **360*a* may be formed in the form of a plate having a wider width, and may include a soft material. Accordingly, the upper end portion and the lower end portion of the shielding body 360*a* may be hung on the pair of rollers 371 and 373. When the rollers 371 and 373 are rotated, the shielding body 360*a* may be provided to move. In this case, the unit mask 361 formed in the shielding body 360*a*** moves such that the image of the beam pattern is changed.

The actuator 375 may be connected to a rotating shaft 372 of any one of the pair of rollers 371 and 373 to rotate the rollers 371 and 373. When the rollers 371 and 373 rotate, the shielding body 360*a* rotates together with the rollers 371 and 373. For example, the actuator 375 may be automatically driven by a control unit.

Meanwhile, the display device 370 may be provided to change the rotating speed of the rollers 371 and 373. Accordingly, the moving speed of the shielding body 360*a* may be changed.

For example, the display device 370 may adjust the speed of changing the dynamic image of the beam pattern by adjusting a revolution per minute of the actuator 375. Alternatively, the display device 370 is stopped or rapidly driven at a specific speed or more, to realize a constant static Meanwhile, for example, a masking pattern formed on each of the plurality of unit masks 361 may have the same image.

In detail, the light transmitting regions 363 of the plurality of unit masks 361 may be formed to have the same shape. Accordingly, the focuses of all second micro-lenses 351 may be provided to be paired with the unit masks 361 formed to have the same masking pattern image.

In this case, the plurality of second micro-lenses 351 may have the same curvature.

In addition, the focus of the second micro-lenses 351 may be provided to be positioned on the shielding part 360. In addition, the shielding part 360 may be provided in such a manner than the masking pattern of the unit mask 361 positioned on a focus of each second micro-lens 351 may constantly have the same shape at any time point, when the actuator 375 is driven.

Therefore, according to the third embodiment of the present disclosure, beam patterns transmitted through the second micro-lenses 351 at any moment may be realized to have the same image.

Meanwhile, referring to FIGS. 15 and 16, according to an embodiment illustrated, the shielding part 360 may include a rear surface portion provided to face the first micro-lens 341 and a front surface portion provided to face the second micro-lenses 351, when viewed based on the rollers 371 and 373 at any time point.

In addition, the unit mask 361 positioned on the focus of the second micro-lenses 351 may be provided to be positioned on the front surface portion.

Hereinafter, the change of the image of the beam pattern by the vehicle lamp 300 will be described with reference to FIGS. 17 and 18, according to a third embodiment of the present disclosure. FIG. 17 illustrates a unit mask 361 formed in the shielding body 360*a*, and FIGS. 18A to 18D illustrate a beam pattern projected onto the road surface 2 through one second micro-lens 351.

When the pair of rollers 371 and 373 rotate forward or reward by the actuator 375, the unit mask 361 may move in the vertical direction while the shielding body 360*a* is moving, as illustrated in FIG. 17 (see directions B1 and B2).

Accordingly, as illustrated in FIG. 18, the beam pattern projected on the road surface 2 may be varied over time. For example, the beam patterns realized through one second micro-lens 351 over time may be sequentially varied in sequence of FIG. 18A, FIG. 18B, FIG. 18C, and FIG. 18D.

However, the shape of the masking pattern of the unit mask 361 or the shape of the changed image according to the present disclosure is not limited to the embodiment illustrated.

Therefore, according to a third embodiment of the present disclosure, the beam pattern formed on the road surface 2 is realized in the form of a dynamic image, thereby producing an effect of changing the attention of a counterpart driver, such that visibility is improved.

In addition, according to the third embodiment of the present disclosure, the beam pattern is realized in the form of a dynamic image, thereby allowing a counterpart driver or a person around the vehicle to intuitively acquire information on a forward direction of the vehicle, when the information on the forward direction of the vehicle is notified to the counterpart driver or the person around the vehicle.

Fourth Embodiment

Figure 19:
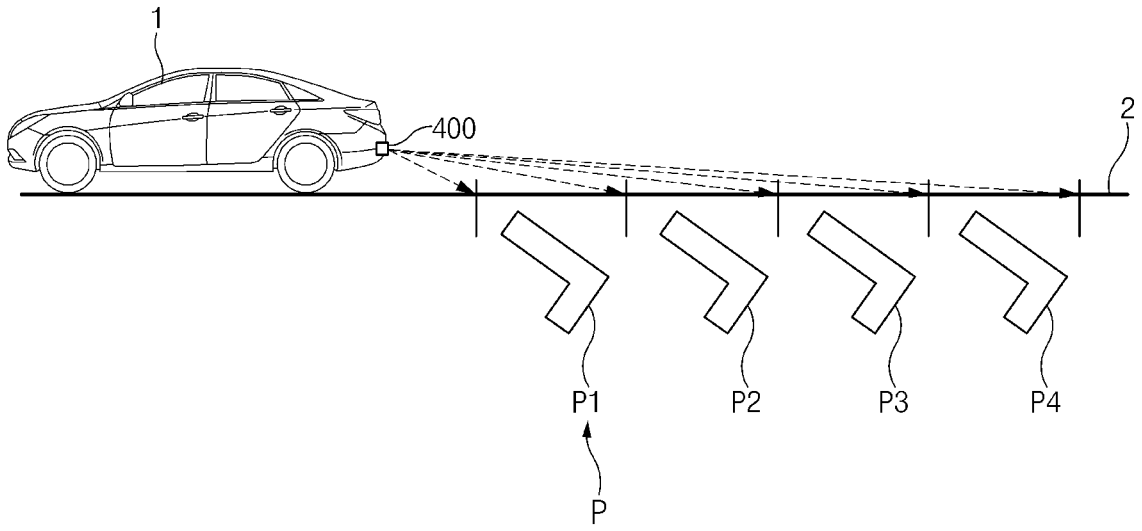
FIG. 19 is a view illustrating that a vehicle lamp is mounted in a vehicle, according to a fourth embodiment of the present disclosure.
Figure 20:
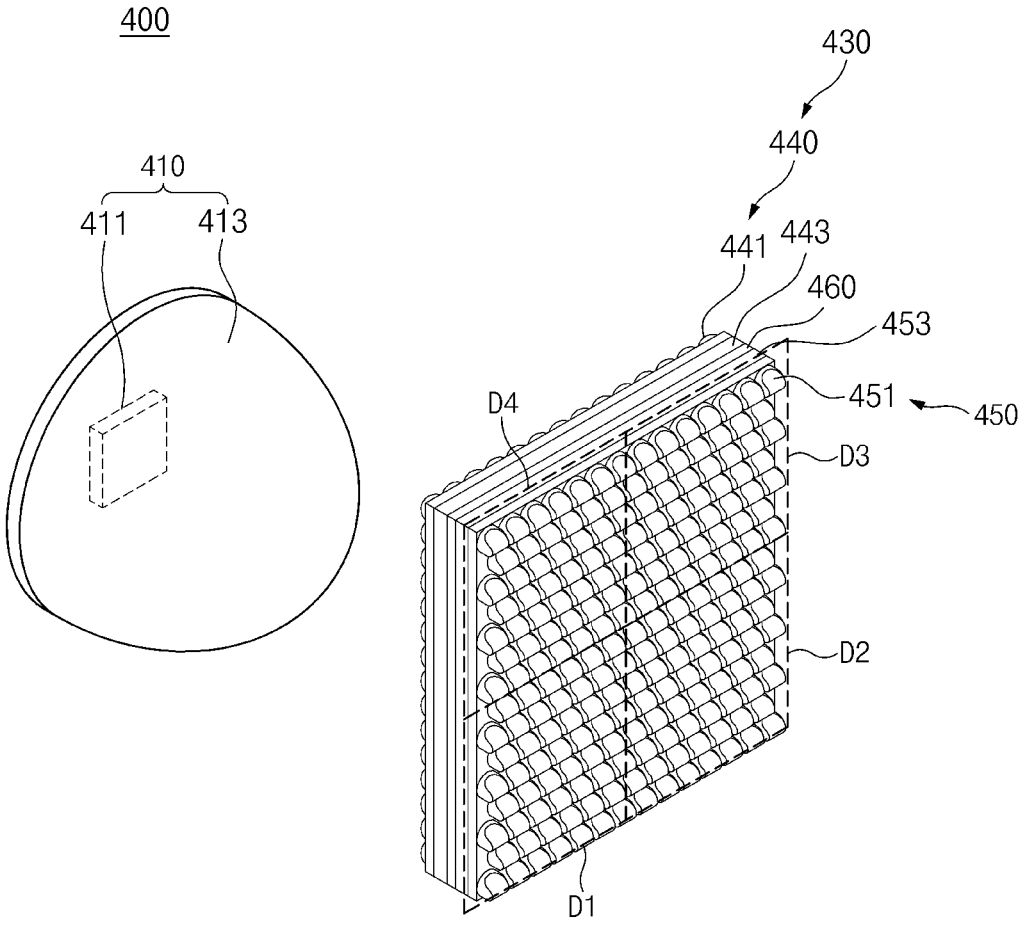
FIG. 20 is a perspective view illustrating a vehicle lamp, according to a fourth embodiment of the present disclosure.
Figure 21:
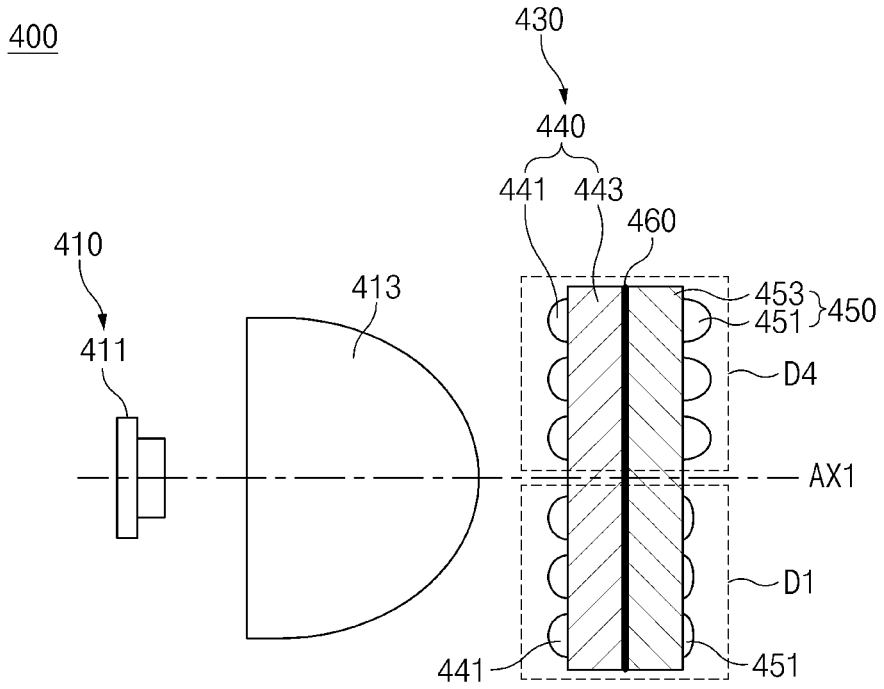
FIG. 21 is a cross-sectional view illustrating a vehicle lamp, according to the fourth embodiment of the present disclosure.
Figure 22A:
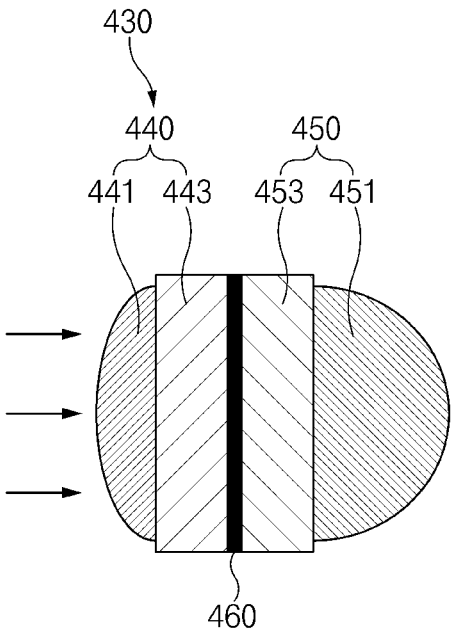
FIG. 22A illustrates a portion of a first partition region of a lens array, according to the fourth embodiment of the present disclosure.
Figure 22B:
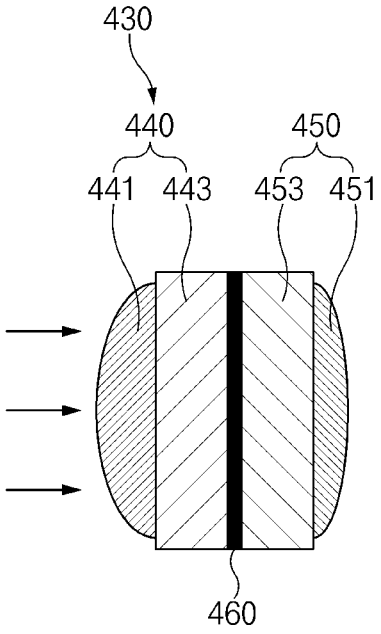
FIG. 22B illustrates a portion a fourth partition region of a lens array, according to the fourth embodiment of the present disclosure.
Figure 23:
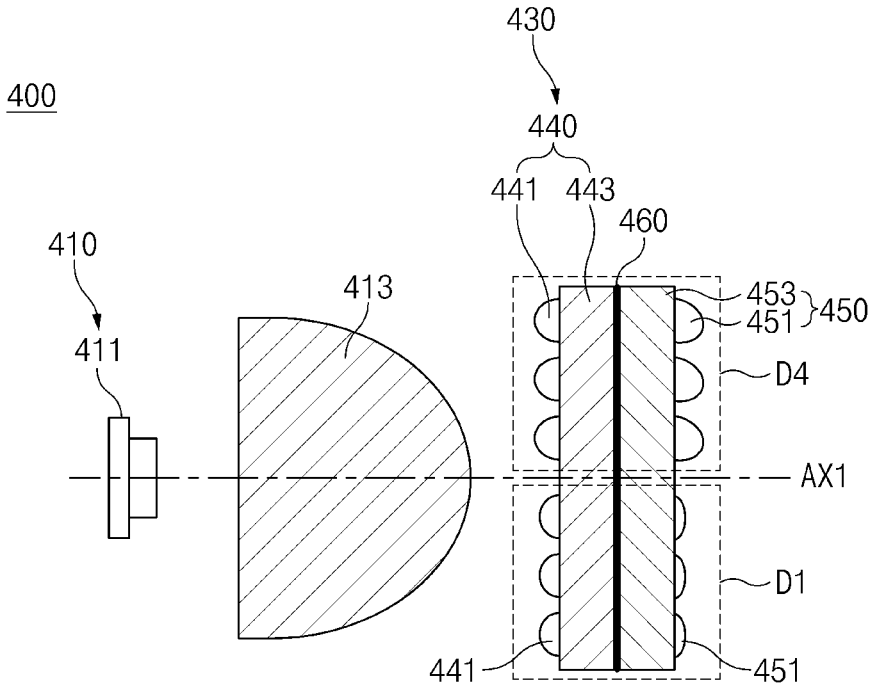
FIG. 23 is a sectional view illustrating a vehicle lamp, according to a modification of the fourth embodiment of the present disclosure.
Figures 1, 24A, 24B, 24C:
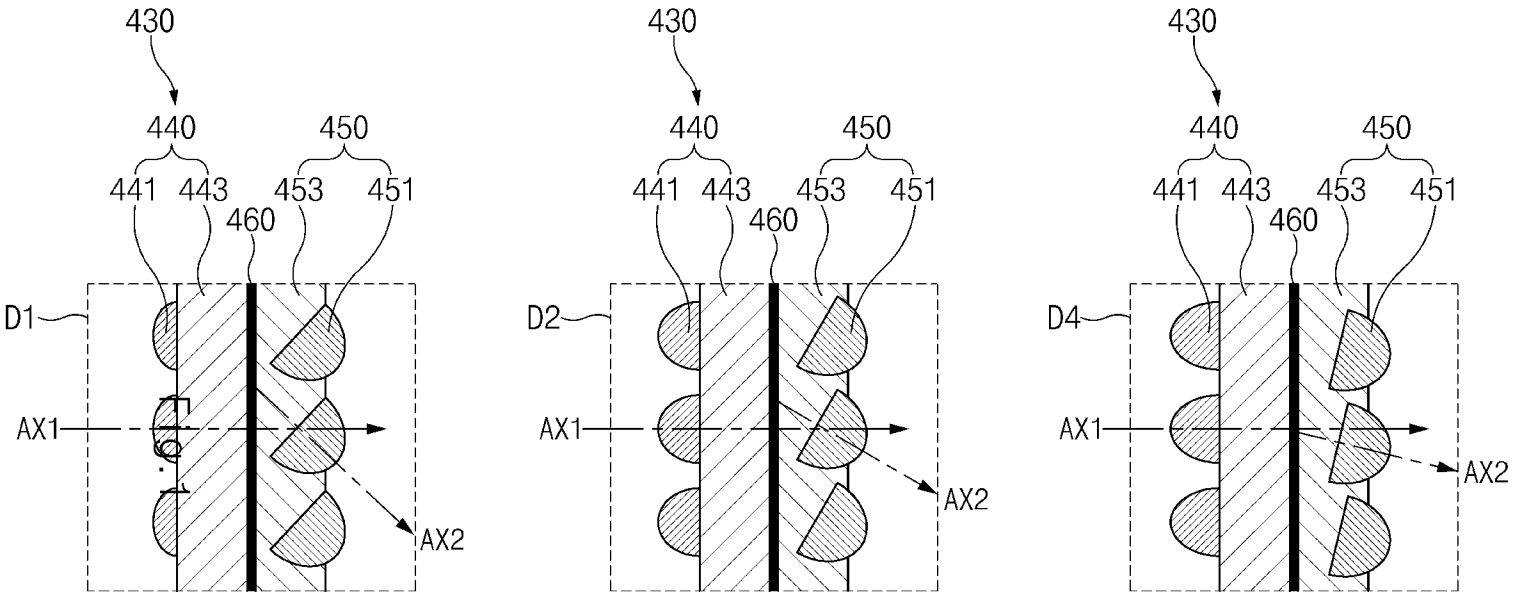
FIG. 24A is an enlarged cross-sectional view illustrating a first partition region of a lens array, according to the fourth embodiment of the present disclosure.
FIG. 24B is an enlarged cross-sectional view illustrating a second partition region of a lens array.
FIG. 24C is an enlarged cross-sectional view illustrating a fourth partition region of a lens array.
Figure 25:
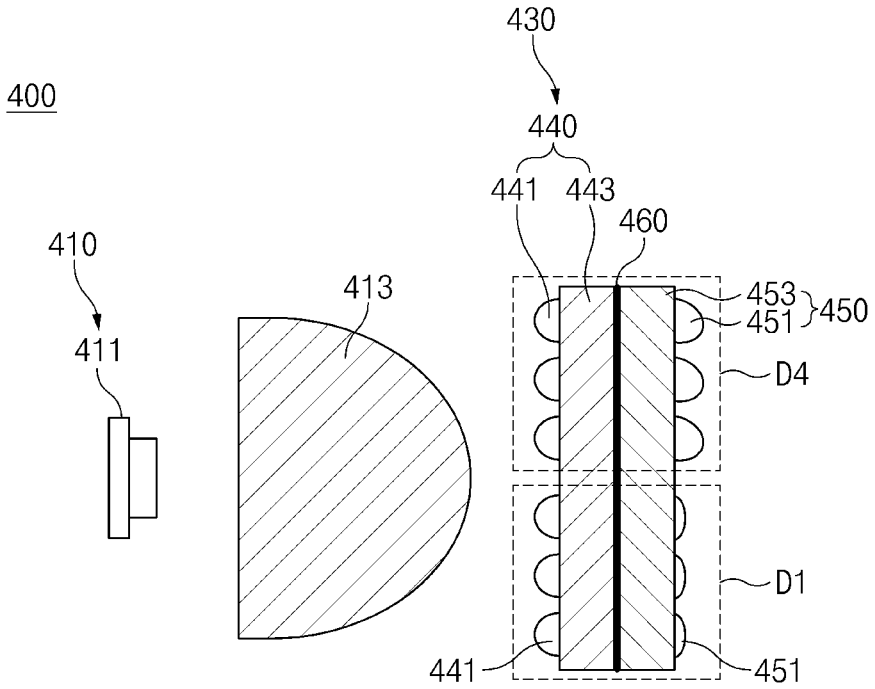
FIG. 25 is a sectional view illustrating a vehicle lamp, according to another modification of the fourth embodiment of the present disclosure.
Figure 26:
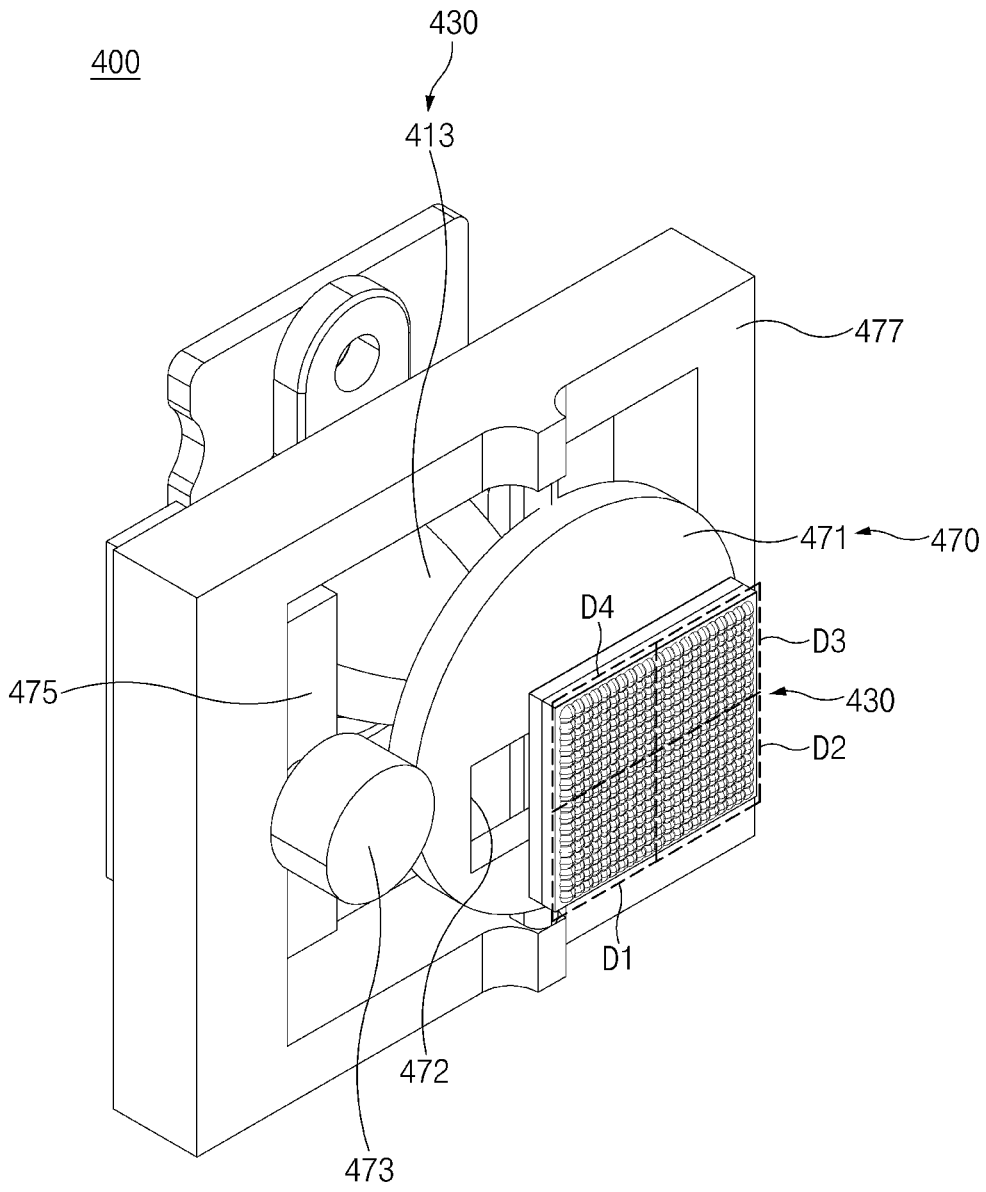
FIG. 26 is a sectional view illustrating a vehicle lamp, according to another modification of the fourth embodiment of the present disclosure.
Figure 27:
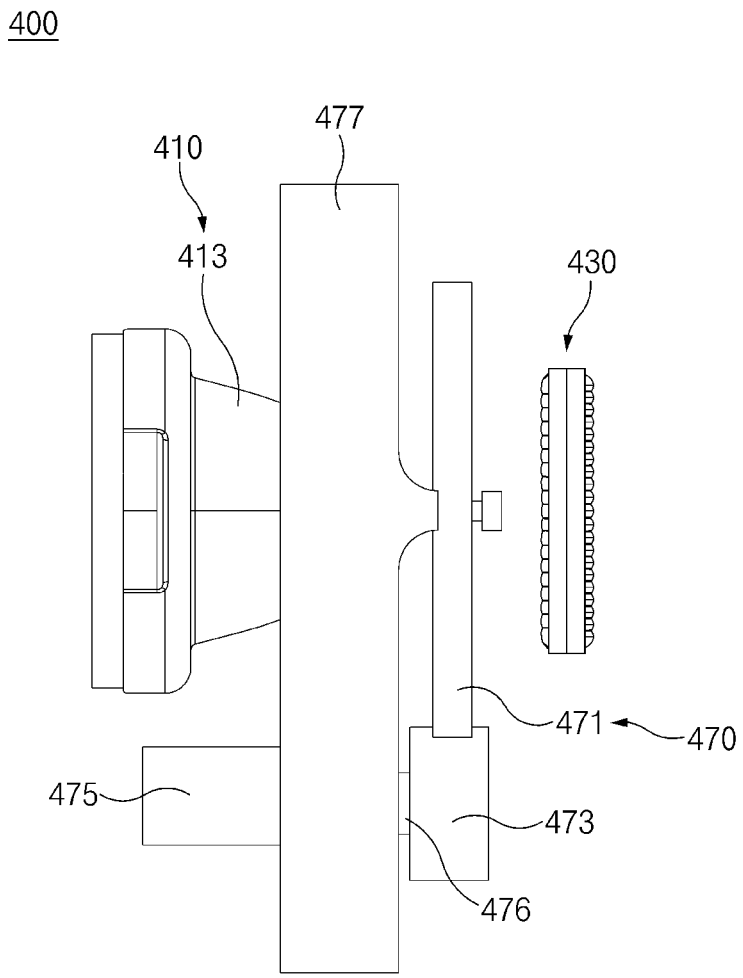
FIG. 27 is a cross-sectional view illustrating a vehicle lamp of FIG. 26.
Figure 28A:
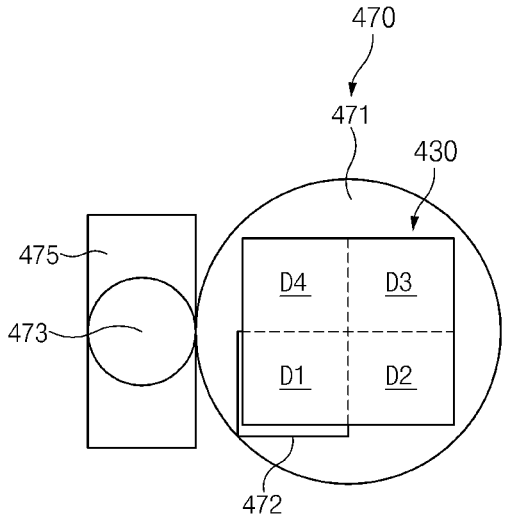
FIGS. 28A to 28D are views illustrating the operation of a vehicle lamp, according to another embodiment of the fourth embodiment of the present disclosure.
Figure 28B:
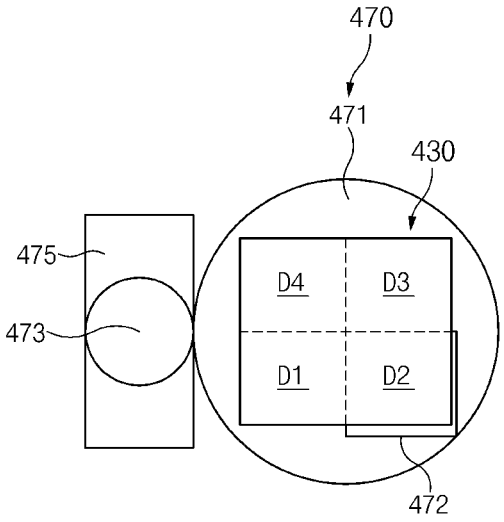
Figure 28C:
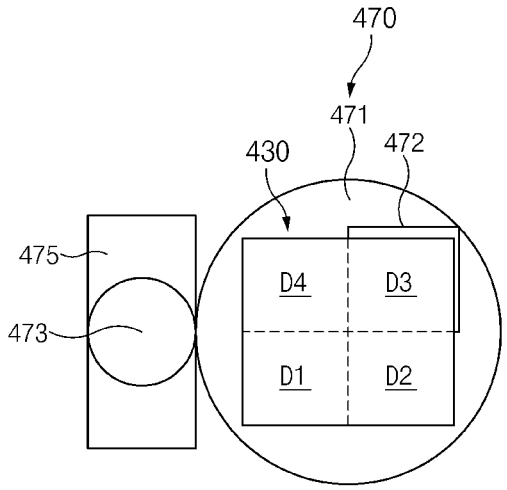
Figure 28D:
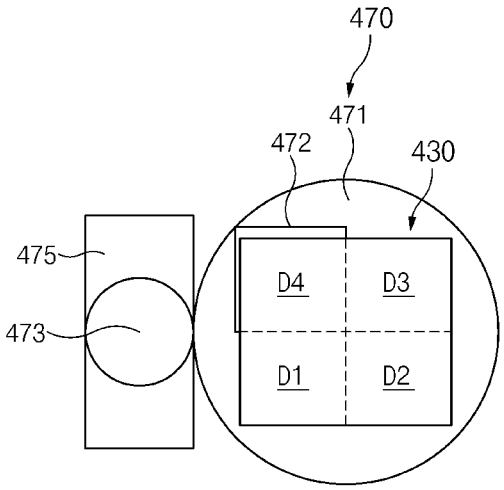

FIGS. 19 to 28 illustrate a fourth embodiment of the present disclosure. FIG. 19 is a view illustrating that a vehicle lamp is mounted in a vehicle, according to a fourth embodiment of the present disclosure. FIG. 20 is a perspective view illustrating a vehicle lamp, according to the fourth embodiment of the present disclosure. FIG. 21 is a cross-sectional view illustrating a vehicle lamp, according to the fourth embodiment of the present disclosure. FIG. 22A illustrates a portion of a first partition region of a lens array, according to the fourth embodiment of the present disclosure. FIG. 22B illustrates a portion a fourth partition region of a lens array, according to the fourth embodiment of the present disclosure. FIG. 23 is a cross-sectional view illustrating a vehicle lamp, according to a modification of the fourth embodiment of the present disclosure. FIG. 24A is an enlarged cross-sectional view of a first partition region of a lens array, according to the fourth embodiment of the present disclosure. FIG. 24B is an enlarged cross-sectional view of a second partition region of a lens array, according to the fourth embodiment of the present disclosure. FIG. 24C is an enlarged cross-sectional view of a fourth partition region of a lens array, according to the fourth embodiment of the present disclosure. FIG. 25 is a cross-sectional view illustrating a vehicle lamp, according to another modification of the fourth embodiment of the present disclosure. FIG. 26 is a perspective view illustrating a vehicle lamp, according to another modification of the fourth embodiment of the present disclosure. FIG. 27 is a cross-sectional view of a vehicle lamp of FIG. 26. FIGS. 28A to 28D are views illustrating the operation of a vehicle lamp, according to another modification of the fourth embodiment of the present disclosure.

Referring to FIGS. 19 to 8C, according to a first embodiment of the present disclosure, the vehicle lamp 400 includes a light source device 410 and a lens array 430. In addition, according to the fourth embodiment of the present disclosure, the vehicle lamp 400 may further include a shielding part 460.

The light source device 410 is provided to generate and irradiate light. The lens array 430 is provided in front of the light source device 410 to output light, which is incident to the lens array 430 from the light source device 410, forward.

For example, the light source device 410 may be provided to irradiate light toward the road surface 2. The light source device 410 may include a light source 411 and a collimator 413. For example, the light source 411 may be, but is not limited to, a light emitting diode (hereinafter, an LED). The collimator 413 may convert light emitted from the light source 411 into light parallel to an optical axis AX1 and may allow the light to be incident into the first lens device 440.

The lens array 430 includes a first lens device 440 and a second lens device 450.

The first lens device 440 includes a plurality of first micro-lenses 441 to receive light incident thereto from the light source device 410. The second lens device 450 includes a plurality of second micro-lenses 451 provided to output the light incident from the first lens device 440.

For example, the first micro-lenses 441 may include incident surfaces which are convex toward the light source device 410, and the incident surfaces of the first micro-lenses 441 may form the whole incident surface of the first lens device 440. Alternatively, the second micro-lenses 451 may include output surfaces which are convex toward the road surface 2, and the output surfaces of the second micro-lenses 451 may form the whole output surface of the second lens device 450. However, the shapes of the first micro-lens 441 and the second micro-lens 451 are not limited to the above shapes.

For example, the first lens device 440 may further include a first light transmitting body 443. The first light transmitting body 443 has a surface facing the light source device 410, and the first micro-lens 441 is formed on the surface. The first light transmitting body 443 may include a material for transmitting light.

For example, the second lens device 450 may further include a second light transmitting body 453. The second micro-lenses 451 is formed on a surface, which faces a direction opposite to a direction facing the first light transmitting body 443, to transmit light. In addition, a second light transmitting body 453 may be provided to face the first light transmitting body 443 while the shielding part 460 is interposed between the first light transmitting body 443 and the second light transmitting body 453.

The first light transmitting body 443 and the second light transmitting body 453 may serve as a body for integrally forming the first lens device 440 and the second lens device 450. However, the present disclosure is not limited thereto. When the first lens device 440 and the second lens device 450 are not integrally formed, at least one of the first light transmitting body 443 and the second light transmitting body 453 may be omitted.

Meanwhile, a beam pattern P is divided into a plurality of pattern regions P1, P2, P3, and P4 depending on a distance from the vehicle lamp 400, and the lens array 430 is divided into a plurality of partition regions D1, D2, D3, and D4 corresponding to the plurality of pattern regions, respectively.

In addition, as a pattern region is positioned at a distance longer from the vehicle lamp 400, the focal length of the second micro-lenses 451, which is provided in the partition region corresponding to the pattern region, may be increased.

In addition, as a pattern region is positioned at a distance longer from the vehicle lamp 400, the curvature of the second micro-lenses 451, which is provided in the partition region corresponding to the pattern region, may be decreased.

In detail, on the assumption that a direction of being away from the vehicle lamp 400 may be a longer distance direction, and a direction opposite to the longer distance direction is a shorter distance direction, when viewed in the beam pattern P, when a pattern region of the plurality of pattern regions of the beam pattern P is positioned at a longer distance in the longer distance direction, a curvature of the second micro-lenses 451 in the partition region corresponding to the pattern region may be decreased.

In addition, as a pattern region is positioned at a distance longer from the vehicle lamp 400, the thickness of the second micro-lenses 451, which is provided in the partition region corresponding to the pattern region, may be increased. In other words, when a pattern region of the plurality of pattern regions of the beam pattern P is positioned at a longer distance in the longer distance direction, the thickness of the second micro-lenses 451 in the partition region corresponding to the pattern region may be increased.

In this case, for example, the first micro-lens 441 and the second micro-lenses 451 provided in the same partition region may be formed to be equal to each other in width in the vertical direction, in which the width is within a machining error range. However, the width of the first micro-lens 441 and the width of the second micro-lens 451 are not limited thereto.

As the curvature of the second micro-lens 451 is decreased, the focal length of the second micro-lens 451 may be increased. In addition, as the thickness of the second micro-lens 451 is increased, the focal length of the second micro-lens 451 may be increased. As the focal length is increased, the luminous intensity is increased, and the field of view (FOV) is decreased.

As described above, according to the present disclosure, a design is made to increase a focal length with respect to a pattern region positioned at a longer distance from the vehicle lamp 400. Accordingly, the luminous intensity of the pattern region positioned at a longer distance in the longer distance direction may be increased. In other words, according to the present disclosure, a design is separately made with respect to each partition region, thereby realizing an optical system having the optimal orientation angle and the optimal luminous intensity.

Accordingly, according to the present disclosure, the light uniformity of the beam pattern P irradiated onto the road surface 2 may be improved.

For example, referring to FIGS. 19 to 22, according to the fourth embodiment of the present disclosure, the plurality of partition regions may be placed in quadrant plates obtained by dividing the lens array 430 about the optical axis AX1 of the light source device 410.

In addition, the plurality of partition regions D1, D2, D3, D4 may be provided to form pattern regions at distances longer from the vehicle lamp 100, counterclockwise from the partition region D1 corresponding to the pattern region at a distance shortest from the vehicle lamp 400.

In detail, the lens array 430 may include the first partition region D1, the second partition region D2, the third partition region D3, and the fourth partition region D4 sequentially placed counterclockwise. In this case, the first partition region D1 may be a partition region corresponding to the first pattern region P1 at the distance shortest from the vehicle lamp 400. In addition, for example, the first partition region D1 to the fourth partition region D4 may be formed to have the same size.

The beam pattern P may include the first pattern region P1 corresponding to the first partition region D1, the second pattern region P2 corresponding to the second partition region D2, the third pattern region P3 corresponding to the third partition region D3, and a fourth pattern region P4. The distance from the vehicle lamp 400 may be increased from the first pattern region P1 toward the fourth pattern region P4.

When viewed from a lateral side of the lens array 430 illustrated in FIG. 21, the first partition region D1 is placed at a lower portion of the lens array 430, and the fourth partition region D4 is placed at an upper portion of the lens array 430. FIG. 22A illustrates a portion of a first partition region D1 of the lens array 430, according to the fourth embodiment of the present disclosure. FIG. 22B illustrates a portion a fourth partition region D4 of the lens array 430, according to the fourth embodiment of the present disclosure.

Referring to FIGS. 21 to 22, the second micro-lens 451 may have a curvature decreased and a focal length increased, from the first partition region D1 toward the fourth partition region D4, The first pattern region P1 to the fourth pattern region P4 have uniform brightness.

Meanwhile, referring to FIGS. 23 and 24, as a pattern region is positioned at a distance longer from the vehicle lamp 400, the curvature of the first micro-lenses 441, which is provided in the partition region corresponding to the pattern region, may be increased.

When the curvature of the first micro-lens 441 is increased, a quantity of light incident through the first micro-lens 441 may be increased. Accordingly, as the quantity of light is increased in the partition region corresponding to the pattern region placed at a longer distance in the longer distance direction, the brightness of the pattern region placed at a longer distance in the longer distance direction may be increased.

However, the curvature of the first micro-lens 441 in each partition region is not limited thereto. According to an embodiment illustrated in FIG. 25, the first micro-lens 441 may be equal curvatures in the partition regions. For example, when a design is made to sufficiently improve the light uniformity based on the thickness, or the curvature of the second micro-lenses 451, the first micro-lens 441 may have an equal curvature.

Meanwhile, referring to FIGS. 23 to 25, on the assumption that an optical axis of light, which is output from the light source device 410 and incident toward the first lens device 440, is referred to as a first optical axis AX1, and an optical axis of light, which is output from the second lens device 450, is referred to as a second optical axis AX2, the lens array 430 is formed such that the second optical axis AX2 is tilted about the first optical axis AX1 to extend toward the road surface 2.

In detail, in the lens array 430, the first optical axis A1, which is an optical axis of light incident to the first lens device 440, and the second optical axis AX2, which is an optical axis of light output from the second lens device 450, may be formed at different angles. For example, the first optical axis AX1 may extend in parallel to the road surface 2, that is, in a longitudinal direction of the vehicle 1. The second optical axis AX2 extends toward the road surface 2 from the second lens device 450, such that the second optical axis AX2 is titled about the first optical axis AX1.

Therefore, according to the present disclosure, when light is irradiated and tilted about the road surface 2 through the vehicle lamp 400, both the light source device 410 and the lens array 430 are not mounted to be tilted toward the road surface 2, but only the second optical axis AX2 of the second lens device 450 is formed to be tilted such that the beam pattern P is formed on the road surface 2. In this case, as compared to when both the light source device 410 and the lens array 430 are mounted to be tilted toward the road surface 2, the height of the lens array 430 in the vertical direction may be reduced. Accordingly, the vehicle lamp 400 in a smaller size may be realized.

FIG. 24A illustrates the first partition region D1, FIG. 24B illustrates the second partition region D2, and FIG. 24C illustrates the fourth partition region D4. As illustrated in FIGS. 24A to 24C, as a pattern region is positioned at a distance longer from the vehicle lamp 400, the size of an acute angle of angles formed between the first optical axis AX1 and the second optical axis AX2 in the partition region corresponding to the pattern region may be reduced.

In detail, as a pattern region is positioned at a distance longer in the longer distance direction, the slop of the second optical axis AX2 about the first optical axis AX1 may be decreased in the partition region corresponding to the pattern region. In other words, as a pattern region is positioned at a distance longer in the longer distance direction, the first optical axis AX1 and the second optical axis AX2 are gradually parallel to each other in the partition region corresponding to the pattern region.

In this case, various manners may be, without limitation, employed to form the second optical axis AX2 of the second lens device 450, such that the second optical axis AX2 is tilted about the first optical axis AX1.

For example, the second lens device 450 may further include the second light transmitting body 453. The second light transmitting body 453 may include the second micro-lenses 451 formed on a surface facing a direction opposite to a direction facing the light source device 410. In addition, the second micro-lenses 451 may be provided in the second light transmitting body 453, such that the thickness direction of the second micro-lenses 451 is titled about the direction of the first optical axis AX1.

Accordingly, the second optical axis AX2 provided in the second lens device 450 may extend in a direction tilted about the first optical axis AX1.

Meanwhile, referring to FIGS. 26 to 28, according to a fourth embodiment of the present disclosure, the vehicle lamp 400 may further include a driving shield unit 470.

The driving shield unit 470 may include a rotating shield 471. The rotating shield 471 may be interposed between the light source device 410 and the lens array 430. In addition, an opening 472 is formed through the rotating shield 471 such that the opening 472 has a size corresponding to the size of any one of the plurality of partition regions.

In detail, the rotating shield 471 may be formed in the shape of a disk perpendicular to the optical axis of the light source device 410. In addition, the driving shield unit 470 may include a driving motor 475 to provide driving force, and a transfer gear 473 connected to a driving shaft 476 of the driving motor 475 and engaged with a gear formed at an edge of the rotating shield 471. In addition, the driving shield unit 470 may further include a driving frame 477 in which the driving motor 475 is mounted.

When the driving motor 475 is driven, the transfer gear 473 connected to the driving shaft 476 may be rotated. In this case, the rotating shield 471 engaged with the transfer gear 473 may be rotated. Light incident from the light source device 410 may be projected forward through the opening 472 of the rotating shield 471, and light may be shielded in a region other than the opening 472. The position of the opening 472 may be changed, as the rotating shield 471 rotates. Accordingly, a region, to which the light from the light source device 410 is incident, of the region for the lens array 230 may be changed.

As described above, the driving shield unit 470 may be provided to transform a lamp image of the beam pattern P, by changing the position of the opening 472, as the rotating shield 471 rotates.

For example, the driving shield unit 470 may rotate the rotating shield 471, such that the opening 472 sequentially corresponds to the first partition region D1 to the fourth partition region D4. (See FIGS. 28A to 28D).

For example, the driving motor 475 may adjust the rotating speed of the rotating shield 471, and may intermittently or continuously rotate the rotation shield 471. For example, when the rotation shield 471 is intermittently rotated, the first pattern region P1 to the fourth pattern region P4 may be sequentially realized. In addition, when the rotating shield 471 is continuously rotated, the beam pattern P may realize a dynamic image. When the rotating shield 471 is rapidly rotated at a specific speed or more, all of the first pattern region P1 to the fourth pattern region P4 may be simultaneously realized to realize a static image.

According to the fourth embodiment of the present disclosure, the vehicle lamp may be designed to have the focal length increased, as a pattern region is positioned at a distance longer from the vehicle lamp. Accordingly, the luminous intensity of the pattern region formed at the longer distance in the longer distance direction may be increased.

In other words, according to the fourth embodiment of the present disclosure, a lens array is separately designed with respect to each partition region, thereby realizing an optical system having the optimal orientation angle and the optimal luminous intensity. Accordingly, according to the present disclosure, the light uniformity of the beam pattern irradiated onto the road surface may be improved.

According to the present disclosure, the vehicle lamp may be designed to have a focal length gradually increased, as a pattern region is positioned at a distance longer from the vehicle lamp, such that the luminous intensity formed at the distance longer in the longer distance direction is increased.

According to an embodiment of the present disclosure, a lens array is separately designed with respect to each partition region, thereby realizing an optical system having the optimal orientation angle and the optimal luminous intensity Accordingly, according to the present disclosure, the light uniformity of the beam pattern irradiated onto the road surface may be improved.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A lamp for a vehicle, comprising:

a light source device configured to generate and output light; and a lens array provided in front of the light source device, wherein the lens array includes:

a first lens device including a plurality of first micro-lenses to receive light from the light source device; and a second lens device including a plurality of second micro-lenses provided to irradiate light from the first lens device onto a road surface to form a specific beam pattern, wherein a curvature of the second micro-lenses is decreased as pattern regions are positioned at a distance further from the lamp;

wherein the beam pattern is divided into a plurality of pattern regions depending on a distance from the lamp, and the lens array is divided into a plurality of partition regions corresponding to the plurality of pattern regions, respectively, and provided to increase a focal length of the second micro-lenses provided in the partition regions corresponding to the pattern region, as the pattern regions are positioned at a distance further from the lamp.

2. The lamp of claim 1, further comprising:

a shielding part interposed between the first lens device and the second lens device to shield a portion of the light from the first lens device to the second lens device, such that a specific beam pattern is formed on the road surface.

3. The lamp of claim 2, wherein the shielding part includes:

a plurality of unit masks provided to correspond to the plurality of second micro-lenses, respectively, and having a masking pattern for forming the beam pattern, wherein the unit mask includes:

a shielding region provided to shield the light; and a light transmitting region provided to transmit the light and having a shape corresponding to the masking pattern.

4. The lamp of claim 1, wherein a thickness of the second micro-lenses is increased as the pattern regions are positioned at the distance further from the lamp.

5. The lamp of claim 1, wherein the first micro-lenses and the second micro-lenses provided in a same partition region are formed to have a same width in a vertical direction, and the width is within a machining error range.

6. The lamp of claim 1, wherein a curvature of a first micro-lenses is increased as the pattern regions are positioned at the distance further from the lamp.

7. The lamp of claim 1, wherein the lens array is formed such that a second optical axis is tilted about a first optical axis to extend toward the road surface.

8. The lamp of claim 7, wherein a size of an acute angle of angles, which are formed between the first optical axis and the second optical axis, is reduced in the partition regions corresponding to the pattern regions, as the pattern regions are positioned at the distance further from the lamp for the vehicle.

9. The lamp of claim 7, wherein the second lens device further includes:

a second light transmitting body, which includes the second micro-lenses formed on a surface facing a direction opposite to a direction facing the light source device, and provided to transmit the light, wherein the second micro-lenses is provided in the second light transmitting body, such that a thickness direction of the second micro-lenses are titled about a direction of the first optical axis.

10. The lamp of claim 1, wherein the plurality of partition regions are placed in quadrant plates obtained by dividing the lens array about an optical axis of the light source device, wherein the plurality of partition regions are provided to form pattern regions at distances which are further from the lamp, counterclockwise from a partition region corresponding to a pattern region positioned at a distance closest to the lamp for the vehicle.

11. The lamp of claim 1, further comprising:

a driving shield unit, that includes:

a rotating shield interposed between the light source device and the lens array, having an opening formed through the rotating shield having a size corresponding to one of the plurality of partition regions and provided to be rotatable.

12. The lamp of claim 11, wherein the rotating shield is formed in a shape of a disk perpendicular to an optical axis of the light source device, wherein the driving shield unit includes:

a driving motor to provide driving force; and a transfer gear connected to a driving shaft of the driving motor and engaged with a gear formed at an edge of the rotating shield, wherein the driving shield unit is provided to transform a lamp image of the beam pattern, by changing a position of the opening, as the rotating shield rotates.

* * * * *